US006229444B1

(12) United States Patent
Endo et al.

(10) Patent No.: US 6,229,444 B1
(45) **Date of Patent: *May 8, 2001**

(54) THEFTPROOF TAG

(75) Inventors: Takanori Endo, Chiyoda-ku; Masami Miyake, Omiya; Takashi Tsuchida, Omiya; Tomohiro Mori, Omiya; Seiro Yahata, Chiyoda-ku, all of (JP)

(73) Assignee: Mitsubishi Materials Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/152,792

(22) Filed: Sep. 14, 1998

(30) Foreign Application Priority Data

Sep. 12, 1997 (JP) ..... 9-248008
Apr. 8, 1998 (JP) ..... 10-095572
May 15, 1998 (JP) ..... 10-133286

(51) Int. Cl.[7] ..... G08B 13/14
(52) U.S. Cl. ..... 340/572.6; 340/572.1
(58) Field of Search ..... 340/572.6, 572.1, 340/586.1, 571

(56) References Cited

U.S. PATENT DOCUMENTS 3,868,842 * 3/1975 Zimmermann et al. ..... 340/572.5
6,018,298 * 1/2000 Endo et al. ..... 340/572.5

* cited by examiner

*Primary Examiner*—Edward Lefkowitz
(74) *Attorney, Agent, or Firm*—Oblon, Spivak, McClelland, Maier & Neustadt, P.C.

(57) ABSTRACT

A theftproof tag which is effective regardless of the material of the article to which it is attached. There is neither a change in resonance of a resonance circuit nor a decrease in the Q value due to the material of the surface of a theft monitored article, thereby decreasing errors in the operation of a theft monitor. The theftproof tag has a resonance circuit resonating to an electric wave at a specified frequency transmitted from a transmitting antenna, and having a coil unit and a capacitor electrically connected to both ends of the coil unit. The coil unit has a magnetic core member made of a composite material composed of a powder or flakes of a soft magnetic metal, and a plastic, and a winding wound around the periphery of the magnetic core member and connected to the capacitor, a portion of the magnetic core member facing the attaching surface of the article.

18 Claims, 11 Drawing Sheets

THEFTPROOF TAG

BACKGROUND OF THE INVENTION

1. Field of the Invention

The present invention relates to a theft monitoring tag for informing that an article is being stolen.

2. Description of the Related Art

A theftproof tag is conventionally disclosed in which a resonance circuit of the tag attached to an article resonates with an electric wave at a specified frequency output from a wave transmitter, a separation detecting means detects whether or not the theft monitoring tag is separated from the article, and a separation informing unit controls a sound output on the basis of the detection output of the separation detecting means (Japanese Unexamined Patent Publication No. 8-185584). In this theftproof tag, the resonance circuit comprises an insulating dielectric thin film and a conductive metallic foil formed in a predetermined shape on either side of the thin film by etching or the like. For example, a coil unit is formed in a spiral form on the surface of the thin film by using a conductive metallic foil, and a surface-side plane pattern of a capacitor connected to the coil unit is formed at the center of the spiral shape of the coil unit.

A transmitting antenna and a receiving antenna are provided in a standing condition at the entrance of a store which sells the theft monitored article at a predetermined distance therebetween, with these antennas being electrically connected to a control unit. The control unit controls the transmitting antenna to transmit an electric wave at a frequency at which the resonance circuit resonates, and checks the signal level of the received signal of the receiving antenna. A speaker is connected to the control output from the control unit for generating an alarm.

In the theftproof tag constructed as described above, when a theft monitored article passes between the transmitting and receiving antennas without payment of money, the resonance circuit of the tag attached to the theft monitored article resonates with an electric wave transmitted from the transmitting antenna, and the receiving antenna receives a received signal modulated to the receiving level. As a result, the control unit controls the speaker to generate an alarm, thereby preventing the article from being stolen without payment of money. When money is paid for the article, a store clerk applies a strong electromagnetic wave to the tag to break the capacitor so that the tag does not operate, or temporarily stops the alarm speaker so as not to generate an alarm.

However, in the conventional theftproof tag, the center line of the spiral coil unit extends perpendicularly to the attaching surface of the article, and thus the electric wave transmitted from the resonance circuit passes through the article. Therefore, if the tag is attached to an article with the surface made of a conductive material such as aluminum, or a ferromagnetic material such as a steel sheet, the magnetic flux generated in the resonance circuit passes through the article to change the self-inductance of the coil unit. Thus, the resonance frequency of the resonance circuit is changed to decrease the Q value, thereby causing the possibility that the tag will not operate, as compared with a tag attached to an article with the surface made of an insulating material or a nonmagnetic material. Assuming that the angular frequency is L, and the resistance component of the resonance circuit is r, the Q value is defined as L/r. It is known that as the Q value increases, the loss due to an eddy current or the like decreases, and the resonance width decreases.

SUMMARY OF THE INVENTION

Accordingly, it is an object of the present invention to provide a theftproof tag which causes neither a change in the resonance frequency of a resonance circuit nor a decrease in the Q value of a coil unit regardless of the material of the surface of an article.

It is another object of the present invention to provide a theftproof tag in which a display plate bonded to the surface of a magnetic core member can be smoothed, thereby improving the appearance of the display plate and decreasing the total thickness.

In accordance with an embodiment of the present invention, there is provided a theftproof tag comprising a resonance circuit attached to a theft monitoring article, resonating with an electric wave at a specified frequency transmitted from a transmitting antenna, and comprising a coil unit and a capacitor electrically connected to both ends of the coil unit.

This construction is characterized in that the coil unit comprises a magnetic core member made of a composite material composed of a powder or flakes of a soft magnetic metal and a plastic, and a winding wound around the periphery of the magnetic core member and connected to the capacitor, and in that a portion of the periphery of the magnetic core member faces the attaching surface of the article.

The magnetic core member may be made of a sintered ferrite sheet, a composite material composed of ferrite powder and a plastic, or a composite material composed of soft magnetic metal powder or flakes, a ferrite powder and a plastic.

In this theftproof tag, since the resonance circuit, which is attached to an article with a surface made of a conductive material such as an aluminum sheet, or a ferromagnetic material such as a steel sheet, resonates to transmit an electric wave in the magnetic core direction of the magnetic core member, i.e., substantially parallel with the attaching surface of the article, the electric wave does not pass through the article and is thus not affected by the material of the article. As a result, the coil unit causes less change in the self-inductance regardless of the material of the surface of the article, and thus the resonance frequency of the resonance circuit changes less, and the Q value of the coil unit is decreased less, thereby decreasing the resonance width of the resonance frequency and improving the resonance properties of the tag.

In accordance with the present invention, the soft magnetic metal is carbonyl iron powder.

In the present invention, the soft magnetic metal may be a reduced iron powder.

In the present invention, the soft magnetic metal may be formed in flakes by further flattening a soft magnetic metal powder pulverized by atomization.

In the present invention, the soft magnetic metal may be a flake-shaped amorphous alloy.

In the theftproof tag of the present invention, the resonance properties of the tag can be improved by forming the soft magnetic metal in an appropriate shape using any one of the above materials.

The theftproof tag of the present invention is further characterized in that the article is made of a ferromagnetic material, and a nonmagnetic electromagnetic shielding sheet or electromagnetic shielding foil having conductivity is bonded to the coil unit facing the attaching surface of the article.

In this theftproof tag, since the electromagnetic shielding sheet or electromagnetic shielding foil is bonded to the coil unit which faces the attaching surface of the article made of a ferromagnetic material, the portion of the magnetic flux emitted from the magnetic core member, which passes through the portion of the article to which the tag is attached, passes above the electromagnetic shielding sheet having high conductivity and does not pass through the article. Since the electromagnetic shielding sheet is non-magnetic and electrically conductive, it causes less hysteresis loss and substantially no eddy current. As a result, the article made of a ferromagnetic material does not influence the resonance circuit, and the coil unit is electromagnetically cut off from the article, thereby completely preventing a change in self-inductance of the coil unit and a decrease in the Q value thereof.

In the theftproof tag of the present invention, the capacitor is bonded to the coil unit facing the attaching surface of the article so that one of the electrodes of the capacitor also serves as the non-magnetic electromagnetic shielding sheet or foil having conductivity.

In the theftproof tag, since the article is made of a ferromagnetic material, the article has no influence on the resonance circuit, and the coil unit is electromagnetically cut off from the article, thereby completely preventing a change in self-inductance of the coil unit and a decrease in the Q value. It is also possible to decrease the number of the parts required, and the total surface area of the tag.

The theftproof tag of the present invention may comprise a single or a plurality of magnetic core members having different magnetic core directions.

Therefore, there is little or no possibility that the tag will be passed between the transmitting antenna and the receiving antenna with the magnetic core members having core magnetic directions in which the sensitivity deteriorates. As a result, it is possible to further improve the sensitivity of the tag and securely prevent the stealing of the article.

The theftproof tag may further comprise a smooth recessed portion which is formed to a depth substantially the same as the diameter of the winding in the portion of the magnetic core member on which the winding is wound so that the entire winding can be contained therein.

In the theftproof tag of the present invention, since the winding is provided on the magnetic core member in the recessed portion thereof, the upper surface of the winding is at substantially the same position as the upper surface of the magnetic core member, and the winding does not project from the recessed portion. Therefore, it is possible to smooth the display plate bonded to the surface of the magnetic core member, improve the appearance of the display plate, and decrease the total thickness of the tag.

The theftproof tag of the present invention may further comprise a plurality of recessed grooves formed in the portion of the magnetic core member around which the wiring is wound so that the turns of the wiring can be respectively contained therein.

In the theftproof tag of the present invention, since the winding is provided on the magnetic core member in the recessed grooves thereof, the winding does not project from the recessed portion. Therefore, it is possible to smooth the display plate bonded to the surface of the magnetic core member, improve the appearance of the display plate, and decrease the total thickness of the tag.

The theftproof tag of the present invention may further comprise a plurality of first recessed grooves formed to a depth at least equal to the diameter of the winding, and a plurality of second recessed grooves formed in a direction different from the first recessed grooves to have a depth two times as large as the diameter of the winding.

In the theftproof tag of the present invention, therefore, it is possible to smooth the display plate bonded to the surface of the magnetic core member, improve the appearance of the display plate, decrease the total thickness of the tag, and significantly decrease or eliminate the probability that the tag will pass between the transmitting antenna and the receiving antenna with the magnetic core member in the direction to decrease the sensitivity of the tag.

In the theftproof tag of the present invention, the capacitor is a chip capacitor bonded to or buried in the side of the magnetic core member.

Therefore, in the theftproof tag of the present invention, since the capacitor is bonded to or buried in the side of the magnetic core member, the smoothness of the display plate bonded to the surface of the magnetic core member does not deteriorate.

The chip capacitor may be provided in parallel with the core magnetic member.

In the theftproof tag of the present invention, the coil unit is contained in a protecting case.

In the theftproof tag of the present invention, therefore, since the fragile magnetic core member is protected by the protecting case, the magnetic core member can be protected from damage.

DESCRIPTION OF THE PREFERRED EMBODIMENT

A first embodiment of the present invention is described below with reference to the drawings.

Figure 1:
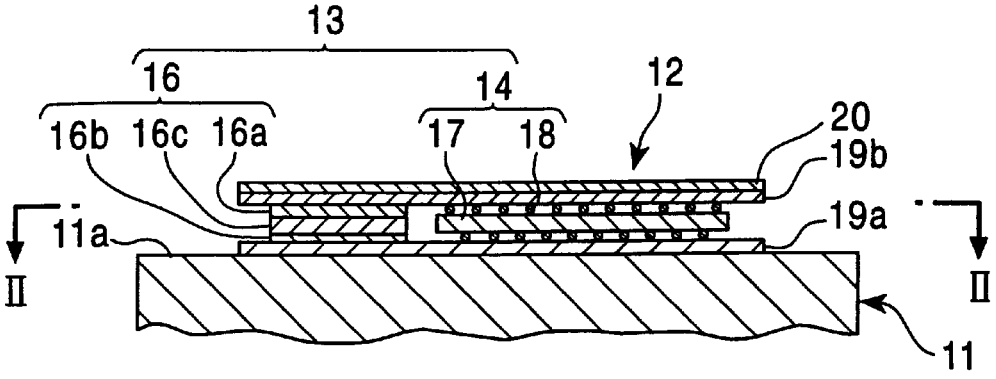
FIG. 1 is a sectional view taken along line I—I in FIG. 2 showing a state in which a theftproof tag in accordance with a first embodiment of the present invention is attached to a attaching surface of an article.
Figure 2:
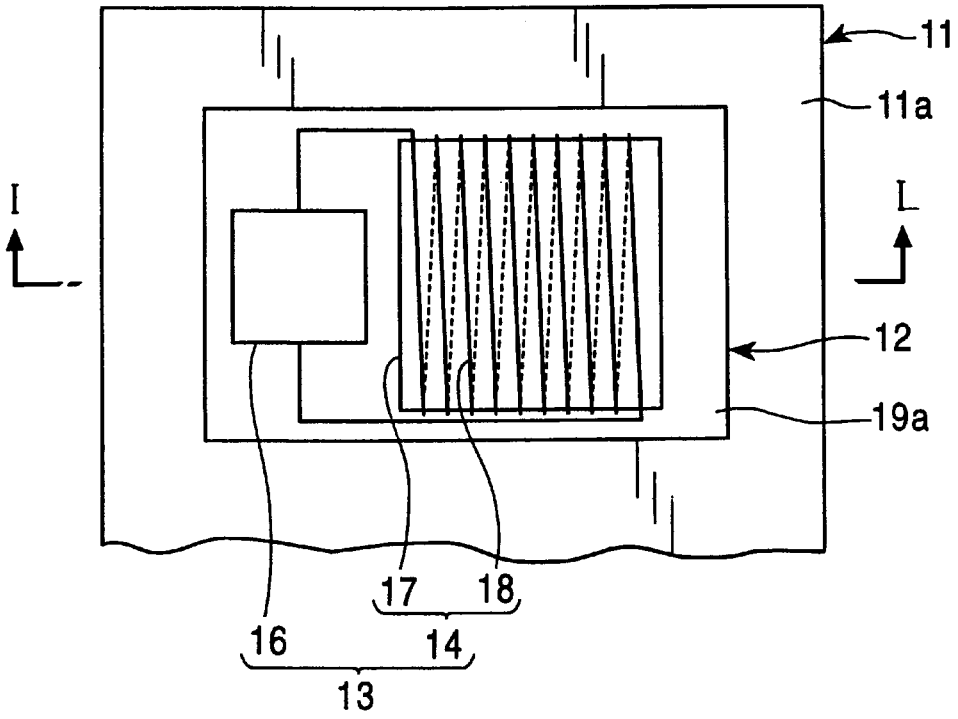
FIG. 2 is a sectional view taken along line II—II in FIG. 1.

Referring to FIGS. 1 and 2, a tag 12 attached to a theft monitored article 11 comprises a resonance circuit 13 which resonates with an electric wave at a predetermined frequency transmitted from a transmitting antenna. In this embodiment, the article 11 is a container made of a conductive material such as aluminum, or a ferromagnetic material such as a steel sheet, which contains drinking water, edible oil or candy. The resonance circuit 13 comprises a coil unit 14 and a capacitor 16 electrically connected to both ends of the coil unit 14. The coil unit 14 comprises a magnetic core member 17, formed in a sheet or foil and made of a composite material composed of soft magnetic metal powder or flakes and a plastic, and a winding 18 wound around the periphery of the magnetic core member 17 with both ends of the winding connected to the capacitor 16. The reason for using the composite material composed of soft magnetic metal powder or flakes and a plastic for the magnetic core member 17 is that since the frequency of the electric wave transmitted from the transmitting antenna is as high as several MHZ to several tens of MHZ, the use of a metallic sheet or foil causes an eddy current and deteriorates its characteristics. Likewise, the use of a sintered ferrite sheet is difficult because it is fragile.

However, if the winding is wound around the periphery of the magnetic core member made of a fragile sintered ferrite sheet to form the coil unit, and the coil unit is contained in a protecting case which will be described below (a tenth embodiment), damage to the magnetic core member (the sintered ferrite sheet) can be prevented.

The magnetic core member may be made of a composite material composed of a ferrite powder and a plastic, or a composite material composed of a soft magnetic metal powder or flakes, a ferrite powder and a plastic.

As the soft magnetic metal, carbonyl iron powder or reduced iron powder from which fine powder can easily be obtained is preferably used. The reduced iron powder can be obtained by reducing fine iron oxide with hydrogen gas or the like at low temperatures. As the soft magnetic metal, flakes may be used, which are obtained by pulverizing iron, permalloy, an amorphous alloy or the like by an atomization method to form a powder of the soft magnetic metal, and then mechanically flattening the powder of the soft magnetic metal. The atomization method is a method in which a metal melt is quenched and pulverized by atomization. This method makes the texture of a metallic material uniform and fine, and can thus improve the composition and texture of the metallic material and improve the reliability of a heat resisting metallic material. Examples of such an atomization method include a water atomization method, a gas atomization method, a vacuum atomization method, and the like. Since the powder of a soft magnetic metal obtained by the atomization method is slightly coarse, it must be mechanically flattened by using a ball mill, an attritor, or the like. When mechanical flattening of a soft magnetic metal powder causes distortion, and thus deteriorates characteristics, annealing is required after flattening. The flakes of an amorphous alloy, obtained by atomizing a melt of an amorphous alloy and contacting it with a copper surface cooled with water, may be used as the soft magnetic metal.

As a method of producing the composite material composed of the soft magnetic metal and a plastic, a method is preferably used in which a mixture of soft magnetic metal powder or flakes and a plastic powder of a nylon resin, a polyethylene resin, an acrylic resin, a vinyl chloride resin, or the like is kneaded, and the kneaded mixture is then pelletized and injection-molded to a predetermined shape. In this case, when injecting the mixture, a magnetic field is applied in the magnetic direction to arrange the soft magnetic metal, thereby further improving the characteristics of the tag. The mixture of a soft magnetic metal powder or flakes and a plastic may be formed in a sheet by a roll, and then cut into strips, compression-molded or cast-molded. In any one of these methods, a magnetic field is applied to arrange the soft magnetic metal, thereby improving its characteristics.

In the case of the soft magnetic metal powder, the diameter of the powder particles is preferably in the range of 0.1 to 30 $\mu$m, more preferably in the range of 0.3 to 5 $\mu$m. In the case of soft magnetic metal flakes, the thickness is preferably in the range of 0.1 to 10 $\mu$m, more preferably in the range of 0.3 to 5 $\mu$m. If the soft magnetic metal powder has a diameter less than the above range, the powder is easily oxidized, and if the diameter is over the range, there is the problem of increasing the loss due to an eddy current. In regard to the mixing ratio of the plastic and the soft magnetic metal, the amount of the soft magnetic metal is preferably 10 to 95% by weight, more preferably 40 to 90% by weight. The balance comprises the plastic. If the soft magnetic metal has a content less than the above range, magnetic permeability is too low, and if the content is over the above range, the soft magnetic metal particles directly contact each other to make the magnetic core member conductive, thereby increasing the loss.

The winding 18 may comprise a wire wound around the magnetic core member 17, or a wire formed by etching. Also the wiring 18 may be formed on the surface of the magnetic core member 17 by printing, or formed to a predetermined thickness on the surface of the magnetic core member 17 by plating. Alternatively, the winding 18 may be formed by depositing a conductive material, by electroless plating, in a groove previously formed in the shape of the winding 18 in the surface of the magnetic core member 17. The capacitor 16 comprises two electrodes 16*a* and 16*b* made of an aluminum foil, an aluminum sheet, a copper foil, or a copper sheet, and a dielectric layer 16*c* made of a paper or plastic sheet, or the like and held between the two electrodes 16*a* and 16*b*. The capacitor may be a chip capacitor. To the electrodes 16*a* and 16*b* are respectively connected both ends of the winding 18.

The resonance circuit 13 is bonded to the article 11 with a first adhesive layer 19*a* therebetween. One of the sides of the sheet- or foil-shaped magnetic core member 17 faces the attaching surface 11*a* of the article 11. To the other side of the magnetic core member 17 is bonded a display plate 20 with a second adhesive layer 19*b* therebetween. On the upper side of the display plate 20 is displayed a price (not shown) by a numerical value or barcode.

At the entrance of a store which sells the article 11 is installed a theft monitor. The monitor comprises a transmitting antenna and a receiving antenna provided in a standing condition at a predetermined distance therebetween, and a control unit in which the control input is connected to the receiving antenna, and the control output is connected to the transmitting antenna and a speaker. The control unit controls the transmitting antenna to transmit an electric wave at a frequency with which the resonance circuit 13 resonates, and always checks the signal level of the received signal of the receiving antenna. In other words, if the signal level of the resonance circuit which receives an electric wave transmitted from the transmitting antenna is at a reference value, the signal level of the receiving antenna which receives the electric wave transmitted from the resonance circuit 13 resonating with the electric wave transmitted from the transmitting antenna is higher than the reference value by a predetermined value, and the speaker is sounded by the control unit.

The operation of the theftproof tag constructed as described above is described.

If the article 11 with the tag 12 attached thereto is stolen from the store and passes between the transmitting antenna and the receiving antenna, the resonance circuit 13 catches the electric wave at a specified frequency transmitted from the transmitting antenna and resonates therewith to cause an AC current in the resonance circuit 13, emitting an electric wave at a frequency determined by the self-inductance of the coil unit and the electrostatic capacity of the capacitor from the resonance circuit 13. The electric wave emitted from the resonance circuit 13 is transmitted in the magnetic core direction of the magnetic core member 17, i.e., substantially parallel with the attaching surface 11*a* of the article 11. Therefore, the electric wave does not pass through the article 11, and thus an eddy current or the like hardly occurs in the surface of the article 11 even if the surface of the article 11 is made of a conductive material or ferromagnetic material. The electric wave emitted from the resonance circuit 13 is hardly affected by the material of the article 11. As a result, since the self-inductance of the coil unit 14 changes less regardless of the material of the surface of the article 11, the resonance frequency of the resonance circuit 13 changes less, and the Q value of the coil unit 14 also decreases less, thereby decreasing the width of resonance of the resonance frequency and improving the resonance characteristics of the tag 12. Therefore, the electric wave emitted from the resonance circuit 13 is securely received by the receiving antenna. On the basis of the received signal, the control unit detects that the article 11 is stolen without payment of the money for the article and sounds an alarm from the speaker.

On the other hand, when money is regularly paid for the article 11, in a checkout (not shown), the capacitor 16 of the resonance circuit 13 is broken by applying a strong electric wave or heat to the tag 12 to cause a short-circuit. As a result, even if the article 11 is passed between the transmitting antenna and the receiving antenna, the resonance circuit is not resonated, and thus the control unit does not sound the speaker. Therefore, it is possible to decrease the number of errors in the operation of the theft monitor such as the speaker generating no alarm when the article 11 is stolen, or the speaker generating an alarm when the article 11 is regularly carried out.

Although, in this embodiment, the article 11 is a container made of a conductive material such as aluminum or the like, or a ferromagnetic material such as a steel sheet or the like, which contains drinking water, edible oil or candy, the article may be made of an insulating material, a non-magnetic material, or any other material. In the case of a book as the article 11, the tag of the present invention can be attached to a sales card by an adhesive, and the sales card can be removed from the book regularly bought at the checkout, thereby preventing the speaker from generating an alarm when the book is passed between the transmitting antenna and the receiving antenna.

Although, in this embodiment, the self-inductance of the coil unit is slightly changed by the material of the article, and the Q value of the coil unit is slightly decreased, a non-magnetic electromagnetic shielding sheet or foil having conductivity, such as an aluminum sheet or foil, can be interposed between the attaching surface of the article and the resonance circuit to electromagnetically cut off the coil unit from the article, thereby completely preventing a change in the self-inductance and a decrease in the Q value. This is particularly effective for an article made of a ferromagnetic material. With the electromagnetic shielding sheet bonded to the coil unit which faces the attaching surface of the article, a portion of the magnetic flux emitted from the magnetic core member and passing through the portion of the article, to which the tag is attached, passes above the electromagnetic shielding sheet. This is also because the electromagnetic shielding sheet causes extremely low hysteresis loss and substantially no eddy current, and the article made of a ferromagnetic material has no influence on the resonance circuit. Although the decrease in the Q value becomes smaller as the thickness of the electromagnetic shielding sheet increases, a thickness of about 10 $\mu$m is sufficient for the electromagnetic shielding sheet from the viewpoint of practical use.

Figure 3:
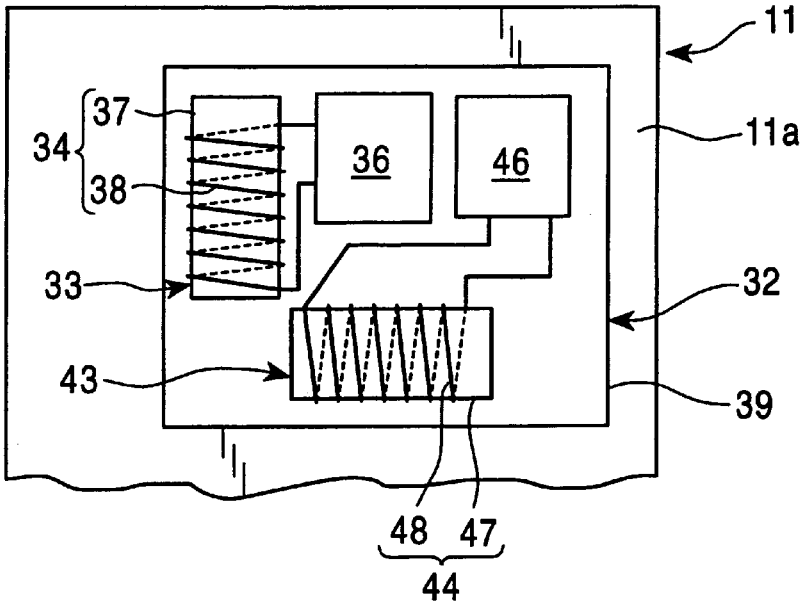
FIG. 3 is a sectional view showing a second embodiment of the present invention corresponding to FIG. 2.

FIG. 3 shows a second embodiment of the present invention. In FIG. 3, the same parts as FIG. 2 are denoted by the same reference numerals.

In this embodiment, a tag 32 comprises two resonance circuits 33 and 43. The coil units 34 and 44 of the respective resonance circuits 33 and 43 have rectangular sheet- or foil-shaped magnetic core members 37 and 47, respectively. These magnetic core members 37 and 47 are arranged at right angles to each other on the attaching surface 11*a* of the article 11. Around the peripheries of the magnetic core members 37 and 47 are wound windings 38 and 48, respectively, so that the magnetic core directions thereof are in the length directions of the magnetic core members 37 and 47, respectively. To both ends of the windings 38 and 48 are connected capacitors 36 and 46, respectively. The resonance circuits 33 and 43 are bonded to the attaching surface 11*a* of the article 11 by an adhesive layer 39.

The operation of the theftproof tag constructed as described above is described below.

When the article 11 passes between the transmitting and receiving antennas with the magnetic core members 37 and 47 positioned in the direction of a line connecting the two antennas, the self-inductance and Q value of each of the coil units 34 and 44 are high, and the tag 32 exhibits high sensitivity. However, when the article 11 passes between the transmitting and receiving antennas with the magnetic core members 37 and 47 positioned in a plane perpendicular to the line connecting the two antennas, the sensitivity deteriorates. Therefore, in this embodiment, the use of the tag 32 comprising the two magnetic core members 37 and 47 and having the magnetic core directions perpendicular to each other significantly decreases the probability that the article 11 passes between the antennas with both the magnetic core members 37 and 47 having magnetic core directions in which the sensitivity of the tag 32 deteriorates. Namely, when the article 11 passes between the two antennas, there is the high probability that one of the two resonance circuits 33 and 43 has good sensitivity, thereby securely preventing the article 11 from being stolen.

The tag of this embodiment is attached to the attaching surface of the article, and the tag of the first embodiment is attached to the surface of the article perpendicular to the attaching surface thereof so that the magnetic core direction of the magnetic core member is perpendicular to the attaching surface. In this case, it is possible to securely prevent the article from being stolen regardless of the state in which the article passes between the antennas.

Figure 4:
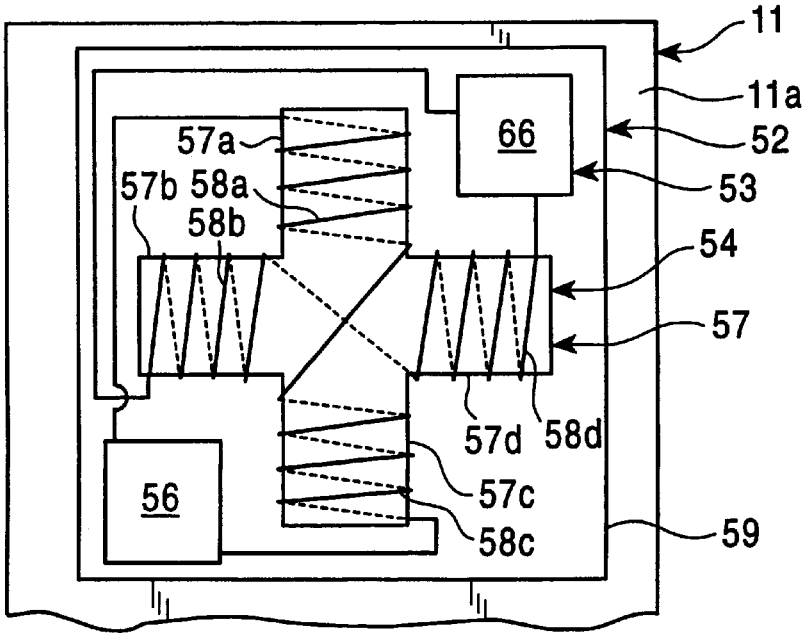
FIG. 4 is a sectional view showing a third embodiment of the present invention corresponding to FIG. 2.

FIG. 4 shows a third embodiment. In FIG. 4, the same parts as FIG. 2 are denoted by the same reference numerals.

In this embodiment, a magnetic core member 57 of a coil unit 54 is formed in a cruciform sheet or foil having four arms including first to fourth arms 57*a* to 57*d* around which first to fourth windings 58*a* to 58*d*, respectively, are wound. The inner ends of the first and third windings 58*a* and 58*c* which are wound around the first and third arms 57*a* and 57*c*, respectively, which are opposite to each other, are connected to each other, and the outer ends of the first and third windings 58*a* and 58*c* are connected to a capacitor 56. The inner ends of the second and fourth windings 58*b* and 58*d*, which are wound around the second and fourth arms 57*b* and 57*d*, respectively, which are opposite to each other, are connected to each other, and the outer ends of the second and fourth windings 58*b* and 58*d* are connected to a capacitor 66. A resonance circuit 53 is bonded to the attaching surface 11*a* of the article 11 by an adhesive layer 59. The winding directions of the first and third windings 58*a* and 58*c* are the same, and the winding directions of the second and fourth windings 58*b* and 58*d* are the same.

Since the operation of the tag 52 constructed as described above is substantially the same as the operation of the tag of the second embodiment, a repeated description is omitted.

Figure 5:
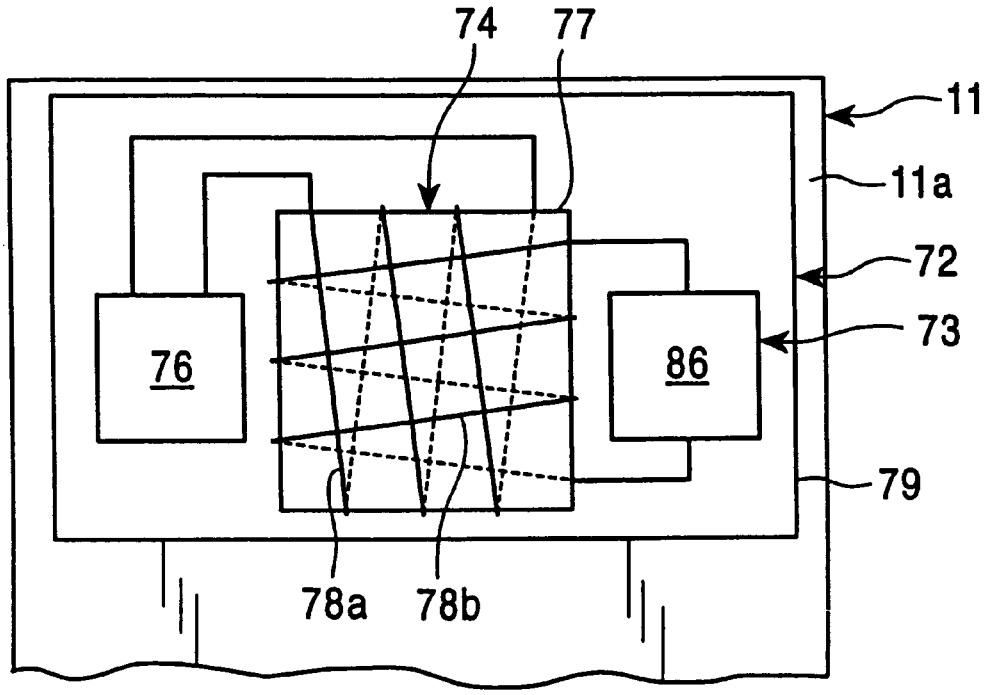
FIG. 5 is a sectional view showing a fourth embodiment of the present invention corresponding to FIG. 2.

FIG. 5 shows a fourth embodiment of the present invention. In FIG. 5, the same parts as FIG. 2 are denoted by the same reference numerals.

In this embodiment, a magnetic core member 77 of a coil unit 74 is formed in the shape of a rectangular sheet or foil, and first and second windings 78*a* and 78*b* are wound around the magnetic core member 77 so as to cross at right angles. Both ends of the first and second windings 78*a* and 78*b* are connected to capacitors 76 and 86, respectively. The first and second windings 78*a* and 78*b* are electrically insulated from each other. A resonance circuit 73 is bonded to the attaching surface 11*a* of the article 11 by an adhesive layer 79.

Since the operation of the tag 72 constructed as described above is substantially the same as the operation of the tag of the second embodiment, a repeated description is omitted.

Figure 6:
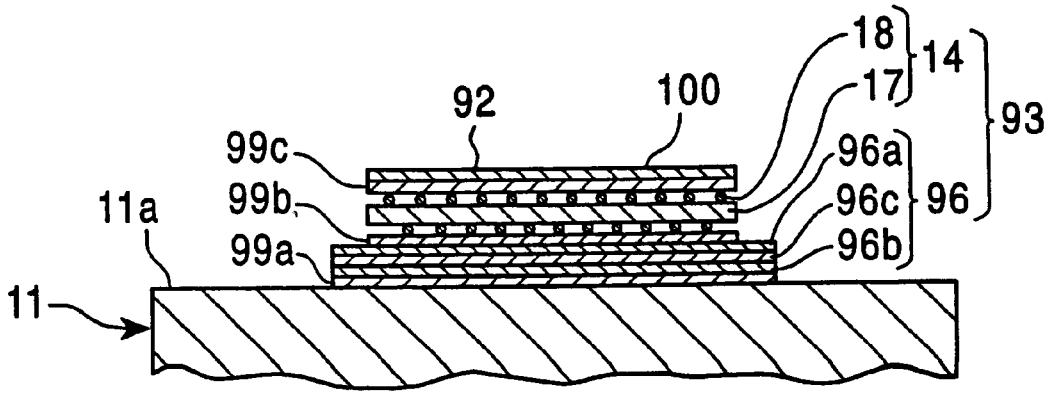
FIG. 6 is a sectional view showing a fifth embodiment of the present invention corresponding to FIG. 1.

FIG. 6 shows a fifth embodiment of the present invention. In FIG. 6, the same parts as FIG. 1 are denoted by the same reference numerals.

In this embodiment, a capacitor 96 is bonded to the coil unit 14 facing the attaching surface 11*a* of the article 11, and one of electrodes 96*a* and 96*b* of the capacitor 96 also serves as a non-magnetic electromagnetic shielding sheet or foil having conductivity. The capacitor 96 comprises the two electrodes 96*a* and 96*b* made of an aluminum foil, an aluminum sheet, a copper foil, a copper sheet, or the like, and a dielectric layer 96*c* made of a paper or plastic sheet, and held between the two electrodes 96*a* and 96*b*. The surface area of each of the electrodes 96*a* and 96*b*, and the dielectric layer 96*c* is the same as or larger than the surface area of the magnetic core member 17. The capacitor 96 is bonded to the attaching surface 11*a* of the article 11 by a first adhesive layer 99*a*, the coil unit 14 is bonded to the surface of the capacitor 96 by a second adhesive layer 99*b*, and a display plate 100 is bonded to the surface of the coil unit 14 by a third adhesive layer 99*c*.

In the tag 92 constructed as described above, one of the electrodes 96*a* and 96*b* of the capacitor 96 also serves as a non-magnetic electromagnetic shielding sheet or foil having conductivity. Therefore, in the article 11 made of a ferromagnetic material, the coil unit 14 is more electromagnetically cut off from the article 11 than the tag of the first embodiment, improving the characteristics of tag 92. In other words, a portion of the magnetic flux emitted from the magnetic core member 17, which passes through the portion of the article 11, to which the tag 92 is attached, passes above one of the electrodes 96*a* and 96*b* having high conductivity, which causes a very low hysteresis loss and substantially no eddy current. As a result, the article 11 made of a ferromagnetic material has no influence on the resonance circuit 93, and the coil unit 14 is electromagnetically cut off from the article 11, thereby completely preventing a change in the self-inductance of the coil unit 14 and a decrease in the Q value. It is also possible to decrease the number of the parts required, and the total surface area by using tag 92.

Figure 7:
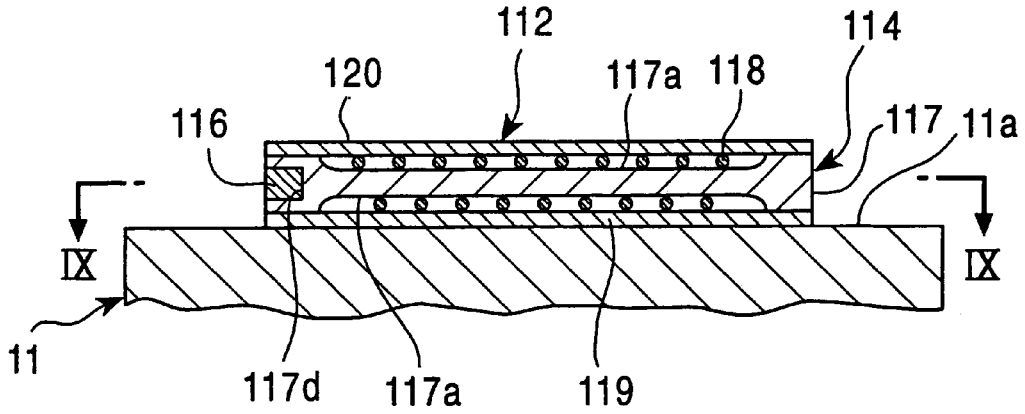
FIG. 7 is a sectional view showing a sixth embodiment of the present invention taken along line VII—VII in FIG. 9.
Figure 8:
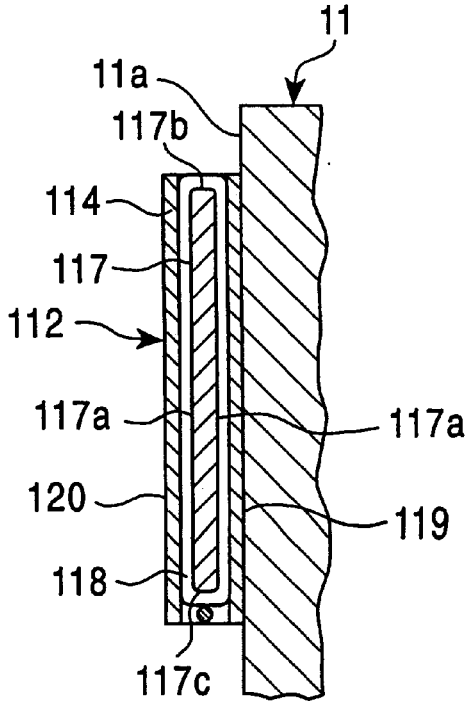
FIG. 8 is a sectional view taken along line VIII—VIII in FIG. 9.
Figure 9:
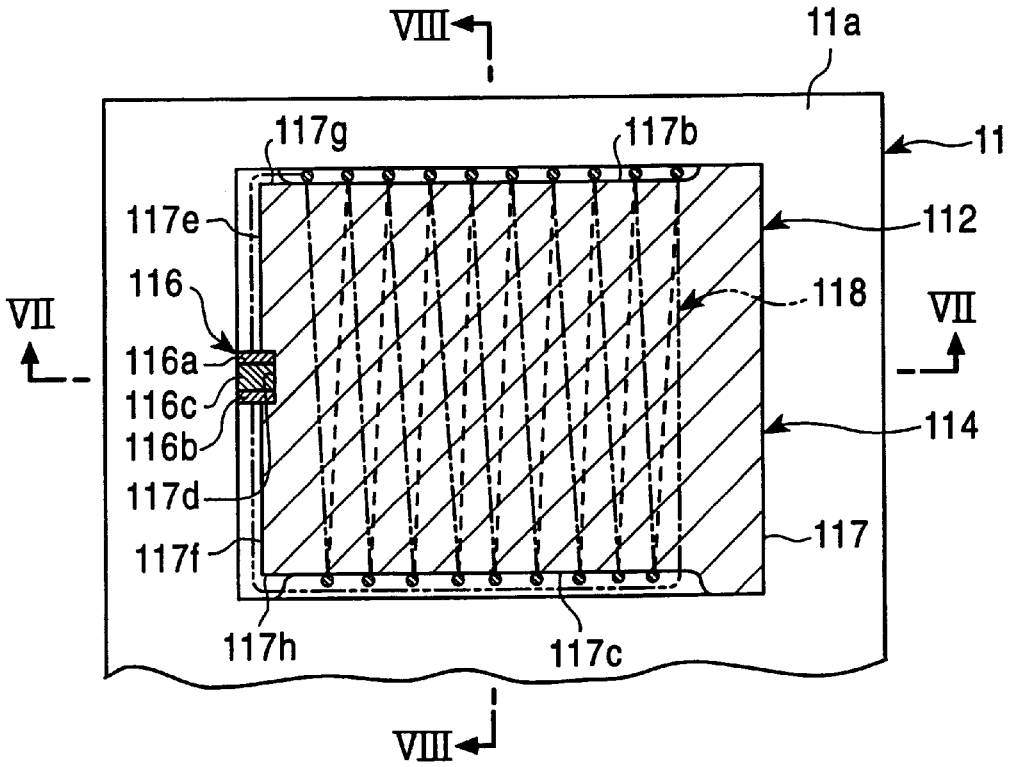
FIG. 9 is a sectional view taken along line IX—IX in FIG. 7.

FIGS. 7 to 9 show a sixth embodiment of the present invention. In FIGS. 7 to 9, the same parts as FIGS. 1 and 2 are denoted by the same reference numerals.

In this embodiment, the article 11 is made of a ferromagnetic material such as an iron sheet or the like, and smooth recessed portions 117*a* (FIGS. 7 and 8) are formed in the portion of a magnetic core member 117 around which a winding 118 is wound so as to contain the entire winding 118. The recessed portions 117*a* are respectively formed on both sides of the magnetic core member 117 so that the depth of the recessed portions 117*a* is substantially the same as the diameter of the winding 118. In one of the pair of lateral sides of the magnetic core member 117 is formed a first winding holding portion 117*b* having a depth substantially equal to the diameter of the winding 118, a second winding holding portion 117*c* having a depth about twice as large as the diameter of the winding 118 is formed in the other side of the magnetic core member 117 (FIGS. 8 and 9).

On the other hand, a capacitor holding hole 117*d* is formed at the center of one of the pair of longitudinal sides of the magnetic core member 117 (FIGS. 7 and 9). In this hole 117*d* are contained first and second electrodes 116*a* and 116*b*, and a dielectric layer 116*c* held between both electrodes 116*a* and 116*b*. In one of the longitudinal sides of the magnetic core member 117 are formed first and second connection holding grooves 117*e* and 117*f* which extend in the length direction of the longitudinal side and which communicate with the capacitor holding hole 117*d* (FIG. 9). The first connection holding groove 117*e* is formed to communicate with the first winding holding portion 117*b* through a first communicating groove 117*g*, and the second connection holding groove 117*f* is formed to communicate with the second winding holding portion 117*c* through a second communicating groove 117*h*. One end of the winding 118 extends from first winding holding portion 117*b* and is electrically connected to the first electrode 116*a* of the capacitor 116 through the first communicating groove 117*g* and the first connection holding groove 117*e*. The other end of the winding 118 extends from the second winding holding portion 117*c* and is electrically connected to the second electrode 116*b* of the capacitor 116 through the second communicating groove 117*h* and the second connection holding groove 117*f*.

To the surface of the magnetic core member 117 is bonded a display plate 120, and the lower side of the magnetic core member 117 is bonded to the article 11 through an electromagnetic shielding sheet 119 (FIGS. 7 and 8). The display plate 120 and the electromagnetic shielding sheet 119 are bonded to the magnetic core member 117 and the article 11, respectively, by adhesive layers (not shown in the drawings).

The electromagnetic shielding sheet 119 is made of a non-magnetic aluminum plate or copper plate having conductivity. An electromagnetic shielding foil made of an aluminum foil or copper foil may be used in place of the electromagnetic shielding sheet. The construction of this embodiment is the same as the first embodiment except as described above.

In the tag 112 constructed as described above, the winding 118 is wound to be contained in the smooth recessed portions 117*a* of the magnetic core member 117 so that the upper surface of the winding 118 is in substantially at the same position as the upper surface of the magnetic core member 117, thereby preventing the winding 118 from projecting from the recessed portions 117*a*, and smoothing the display plate 120 bonded to the surface of the magnetic core member 117. As a result, it is possible to improve the appearance of the display plate 120, and decrease the total thickness of the tag 112. Also, since the capacitor 116 is buried in one of the longitudinal sides of the magnetic core member 117, the appearance of the tag 112 can be improved without deteriorating the smoothness of the display plate 120. Furthermore, since the coil unit 114 comprising the magnetic core member 117 and the winding 118 is electromagnetically cut off from the article 11 made of a ferromagnetic material, the characteristics of the tag 112 are improved. Namely, a portion of the magnetic flux emitted from the magnetic core member 117, which passes through the portion of the article 11 to which the tag 112 is attached, passes above the electromagnetic shielding sheet 119 having high conductivity, and the electromagnetic shielding sheet 119 causes an extremely low hysteresis loss and substantially no eddy current. As a result, the article 11 made of a ferromagnetic material has no influence on the resonance circuit 113 comprising the coil unit 114 and the capacitor 116, and the coil unit 114 is electromagnetically cut off from the article 11, thereby completely preventing a change in the self-inductance of the coil unit 114 and a decrease in the Q value.

Figure 10:
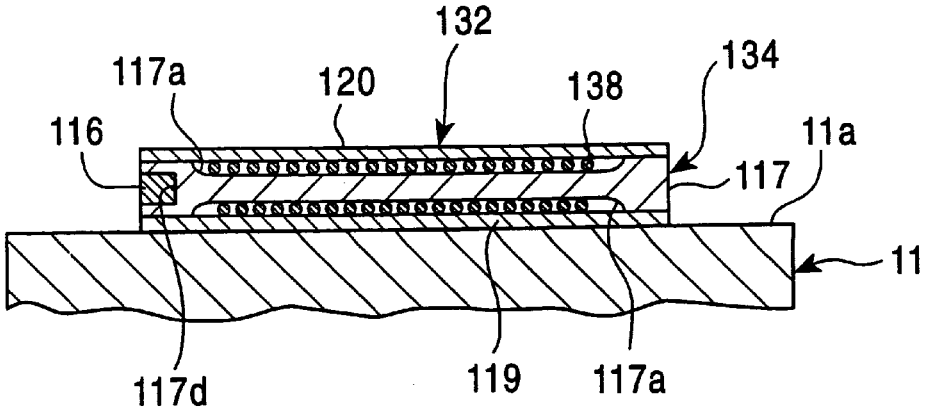
FIG. 10 is a sectional view showing a seventh embodiment of the present invention corresponding to FIG. 7.

FIG. 10 shows a seventh embodiment of the present invention. In FIG. 10, the same parts as FIG. 7 are denoted by the same reference numerals.

In this embodiment, a winding 138 is closely wound in the smooth recessed portions 117*a* of the magnetic core member 117. The construction of this embodiment is the same as the sixth embodiment except as noted. The magnetic core member 117 and the winding 138 constitute a coil unit 134.

In the tag 132 constructed as described above, since the winding 138 is closely wound, the distances of the recesses between the adjacent turns of the winding 138 are very small, and thus the smoothness of the display plate 120 can further be improved.

Figure 11:
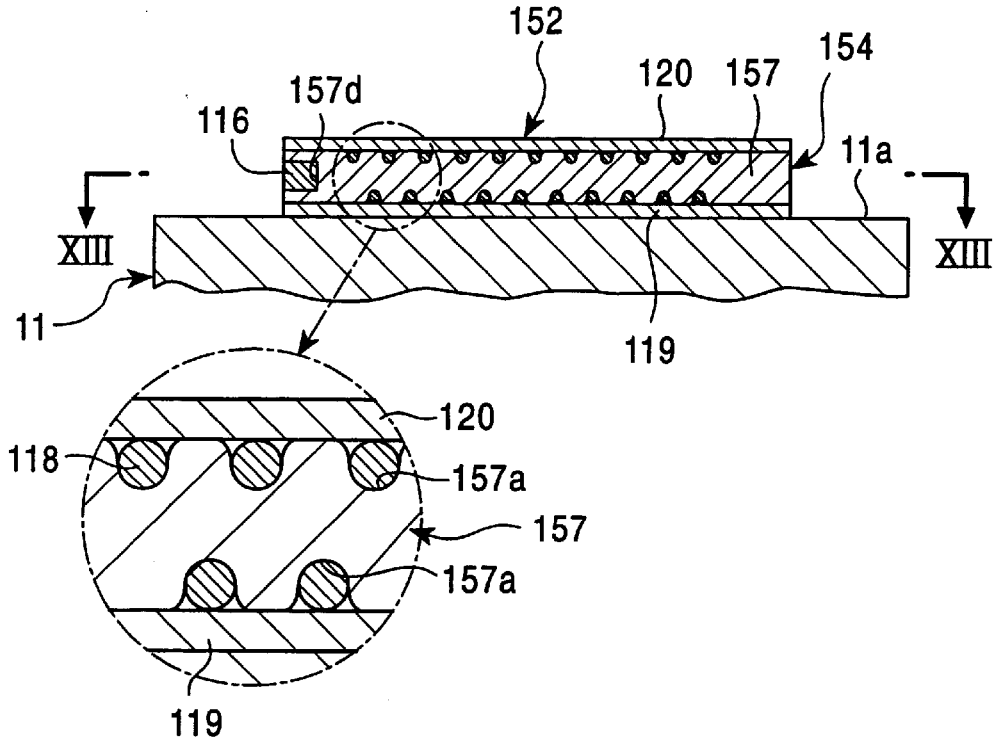
FIG. 11 is a sectional view showing an eighth embodiment of the present invention taken along line XI—XI in FIG. 13.
Figure 12:
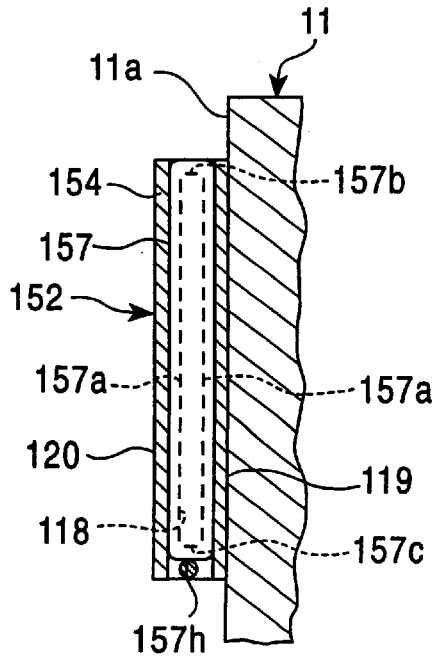
FIG. 12 is a sectional view taken along line XII—XII in FIG. 13.
Figure 13:
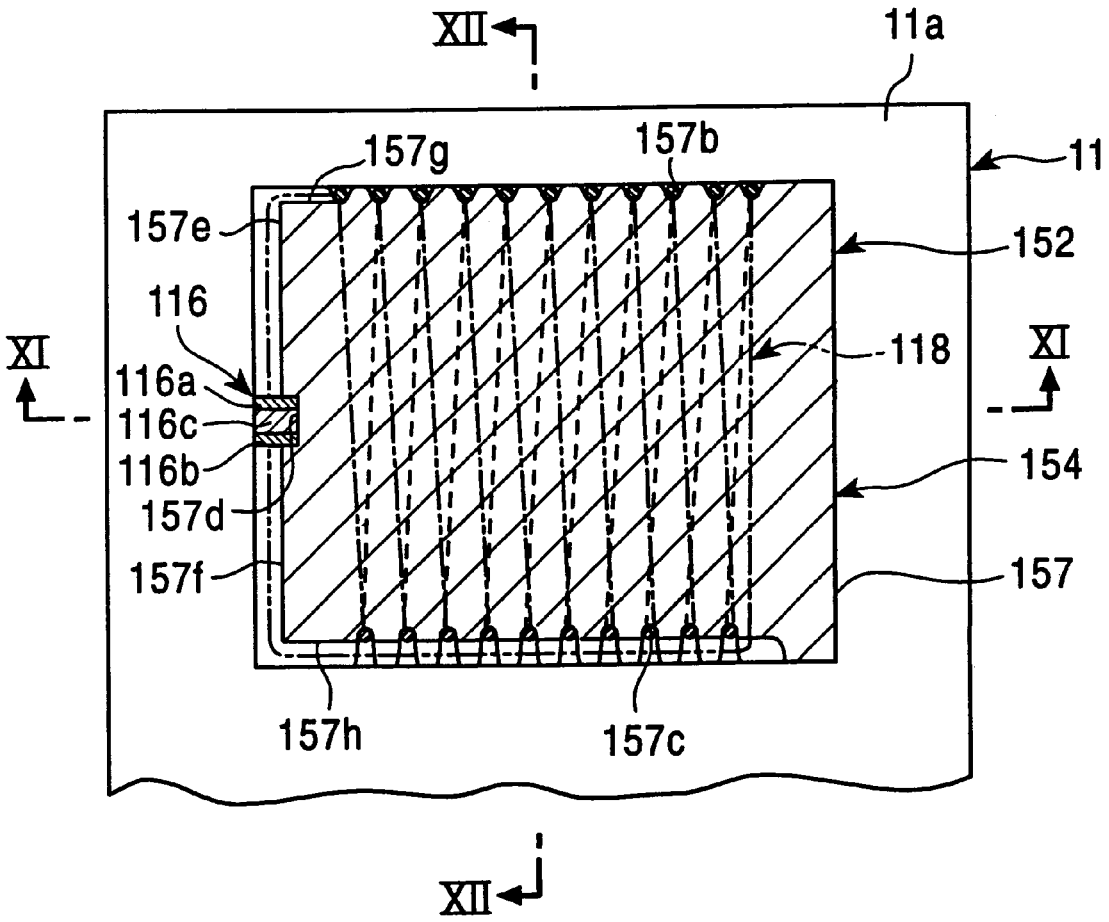
FIG. 13 is a sectional view taken along line XIII—XIII in FIG. 11.

FIGS. 11 to 13 show an eighth embodiment of the present invention. In FIGS. 11 to 13, the same parts as FIGS. 7 to 9 are denoted by the same reference numerals.

In this embodiment, in the portion of a magnetic core member 157, on which the winding 118 is wound, are formed a plurality of grooves 157*a* which can respectively contain the turns of the winding 118 (FIGS. 11 and 12). The grooves 157*a* are respectively formed in both sides of the magnetic core member 157 to have a depth substantially equal to the diameter of the winding 118. In one of the pair of lateral sides of the magnetic core member, are formed first winding holding grooves 157*b* respectively communicating with the grooves 157*a* and having a depth substantially equal to the diameter of the winding 118. In the other lateral side of the magnetic member 157 are formed second winding holding grooves 157*c* respectively communicating with the grooves 157*a* and having a depth about twice as large as the diameter of the winding 118 (FIGS. 12 and 13). The grooves 157*a*, the first winding holding grooves 157*b* and the second winding holding grooves 157*c* form a spiral groove.

The chip capacitor 116 is contained in the capacitor holding hole 157*d* formed at the center of one of the pair of longitudinal sides of the magnetic core member 157 (FIGS. 11 and 13). In one of the longitudinal sides of the magnetic core member 157 are formed first and second connection holding grooves 157*e* and 157*f* extending in the length direction of this longitudinal side and communicating with the capacitor holding hole 157*d* (FIG. 13). The first connection holding groove 157*e* is formed to communicate with the first winding holding grooves 157*b* through a first communicating groove 157*g*, and the second connection holding groove 157*f* is formed to communicate with the second winding holding groove 157*c* through a second communicating groove 157*h*. One end of the winding 118 extends from the first winding holding grooves 157*b* and is electrically connected to the first electrodes 116*a* of the capacitor 116 through the first communicating groove 157*g* and the first connection holding groove 117*e*. The other end of the winding 118 extends from the second winding holding grooves 157*c* and is electrically connected to the second electrode 116*b* of the capacitor 116 through the second communicating groove 157*h* and the second connection holding groove 157*f*. The magnetic core member 157 and the winding 118 constitute a coil unit 154. The construction of this embodiment is the same as the sixth embodiment except as noted above.

In the tag 152 constructed as described above, the winding 118 is wound so as to be contained in the grooves 157*a* of the magnetic core member 157 so that the upper side of the winding 118 is at substantially the same position as the upper side of the magnetic core member 157, thereby preventing the winding 118 from projecting from the grooves 157*a* and smoothing the display plate 120 bonded to the surface of the magnetic core member 157. As a result, it is possible to improve the appearance of the display plate 120, and decrease the total thickness of the tag 152.

Although, in this embodiment, the depth of the grooves is substantially the same as the diameter of the winding, the depth of the grooves may be larger than the diameter of the winding. In this case, the upper side of the winding contained in the grooves is lower than the upper side of the magnetic core member, but the smoothness of the display plate hardly deteriorates due to the small width of the grooves (slightly larger than the diameter of the winding).

Figure 14:
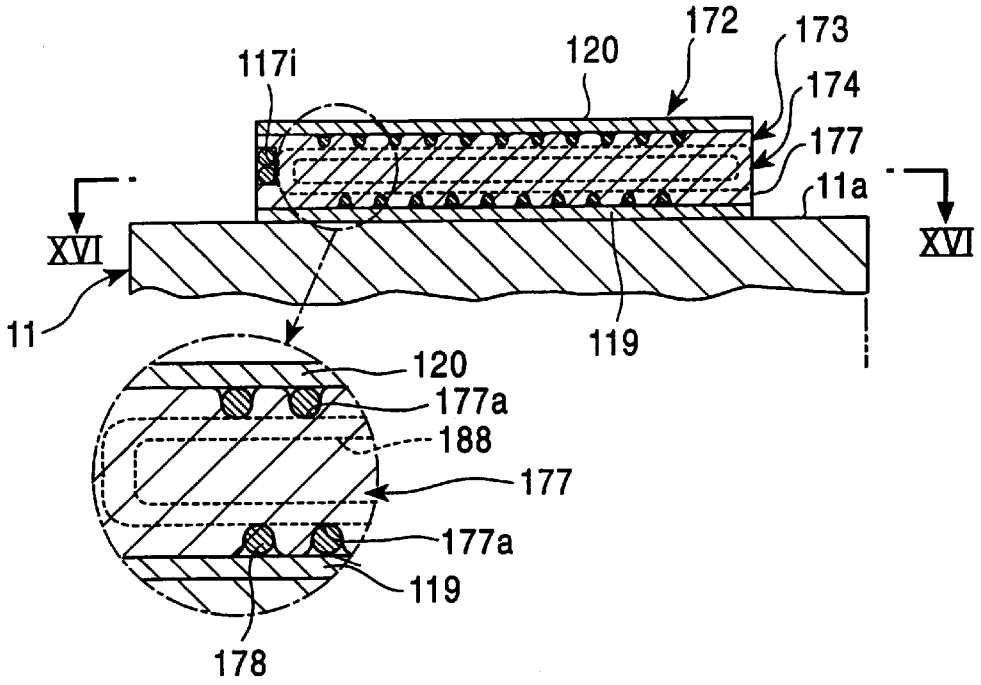
FIG. 14 is a sectional view showing a ninth embodiment of the present invention taken along line XIV—XIV in FIG. 16.
Figure 15:
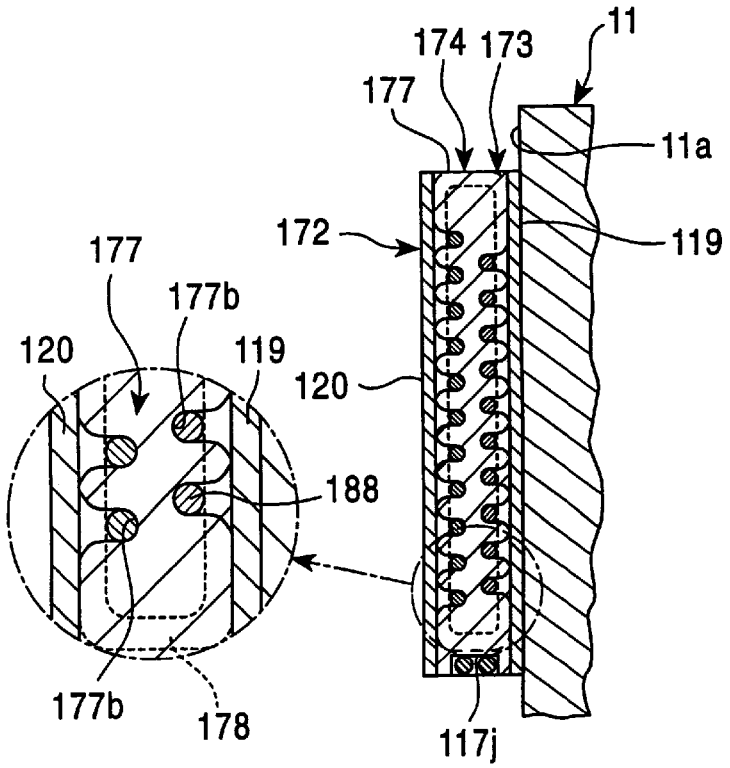
FIG. 15 is a sectional view taken along line XV—XV in FIG. 16.
Figure 16:
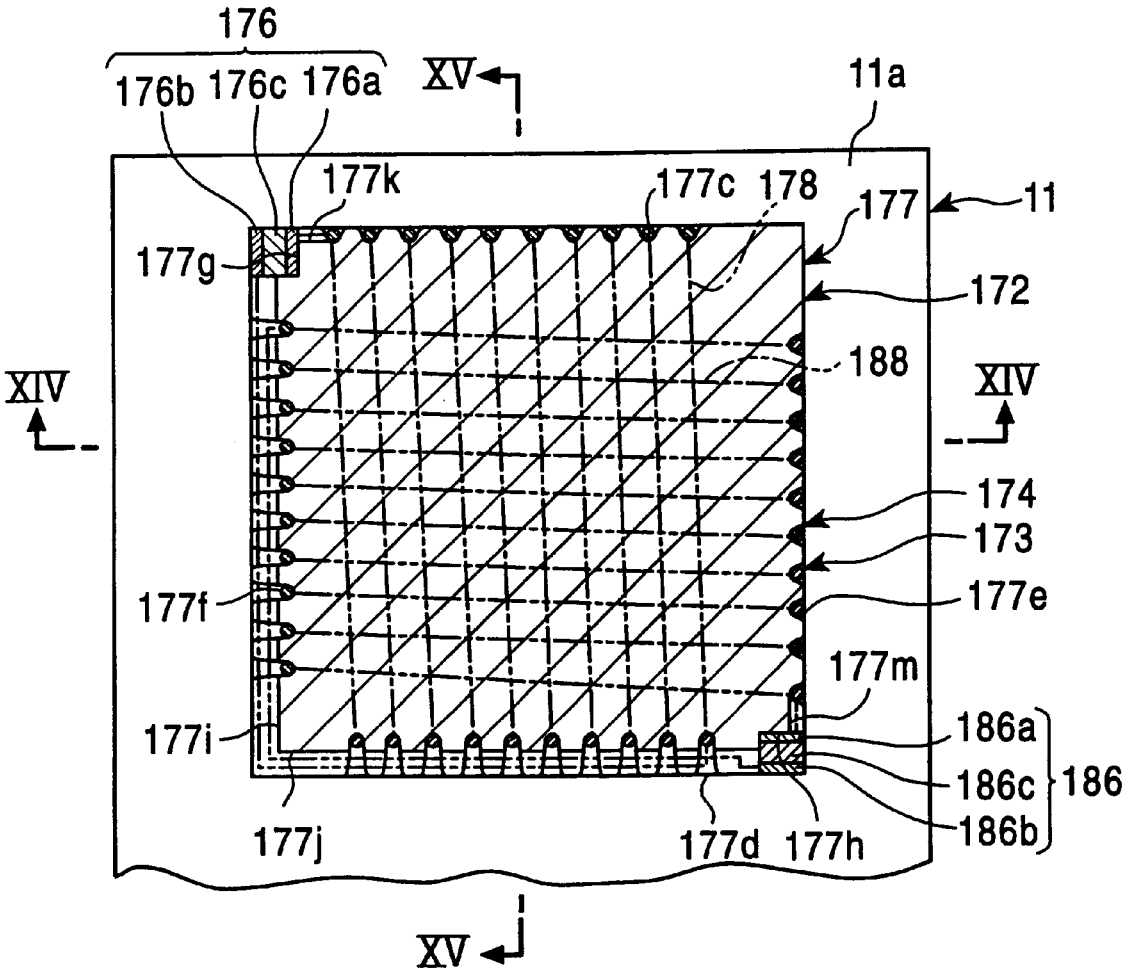
FIG. 16 is a sectional view taken along line XVI—XVI in FIG. 14.

FIGS. 14 to 16 show a ninth embodiment of the present invention. In FIGS. 14 to 16, the same parts as FIGS. 7 to 9 are denoted by the same reference numerals.

In this embodiment, a magnetic core member 177 has a plurality of first grooves 177*a* formed at a depth substantially equal to the diameter of a longitudinal winding 178, and a plurality of second grooves 177*b* formed in a direction different from the first grooves 177*a* to have a depth about twice as large as the diameter of a lateral winding 188 (FIGS. 14 and 15). The longitudinal winding 178 and the lateral winding 188 have the same diameter. The first grooves 177*a* are formed in both sides of the magnetic core member 177 to extend substantially longitudinally, and the second grooves 177*b* are formed in both sides of the magnetic core member 177 to substantially extend laterally (FIG. 16). In one of the pair of lateral sides of the magnetic core member 177, which laterally extend, are formed first longitudinal winding holding grooves 177*c* communicating with the first grooves 177*a* and having a depth substantially equal to the diameter of the longitudinal winding 178. In the other lateral side of the magnetic core member are formed second longitudinal winding holding grooves 177*d* having a depth about twice as large as the diameter of the longitudinal winding 178. In one of the pair of longitudinal sides of the magnetic core member 177, which extend longitudinally, are formed first lateral winding holding grooves 177*e* communicating with the second grooves 177*b* and having a depth substantially equal to the diameter of the lateral winding 188. In the other longitudinal side are formed second lateral winding holding grooves 177*f* having a depth about twice as large as the diameter of the lateral winding 188.

On the other hand, at the pair of diagonal corners of the magnetic core member 177 are respectively formed first and second capacitor holding holes 177*g* and 177*h* (FIG. 16). In these holes 177*g* and 177*h* are contained first and second capacitors 176 and 186 comprising first electrodes 176*a* and 186*a* and second electrodes 176*b* and 186*b*, and dielectric layers 176*c* and 186*c* held between the first electrodes 176*a* and 186*a*, and the second electrodes 176*b* and 186*b*, respectively. These capacitors 176 and 186 are chip capacitors. In one of the longitudinal sides of the magnetic core member 177 is formed a first connection holding groove 177*i* extending in the length direction of the other longitudinal side and communicating with the first capacitor holding hole 177*g*. In one of the lateral sides is formed a second connection holding groove 177*j* extending the length direction of the other lateral side and communicating with the second capacitor holding hole 177*h*. In the other lateral side of the magnetic core member 177 is formed a first communicating groove 177*k* communicating with the first longitudinal winding holding grooves 177*c* and the first capacitor holding hole 177*g*. In the other longitudinal side of the magnetic core member 177 is formed a second communicating groove 177*m* communicating with the first lateral winding holding grooves 177*e* and the second capacitor holding hole 177*h*. One end of the longitudinal winding 178 extends from the first longitudinal winding holding grooves 177*c* and is electrically connected to the first electrode 176*a* of the first capacitor 176 through the first communicating groove 177*k*, and the other end of the longitudinal winding 178 extends from the second longitudinal winding holding grooves 177*d* and is electrically connected to the second electrode 176*b* of the first capacitor 176 through the second connection holding groove 177*j* and the first connection holding groove 177*i*. One end of the lateral winding 188 extends from the first lateral winding holding grooves 177*e* and is electrically connected to the first electrode 186*a* of the second capacitor 186 through the second communicating groove 177*m*, and the other end of the lateral winding 188 extends from the second lateral winding holding grooves 177*f* and is electrically connected to the second electrode 186*b* of the first capacitor 186 through the first connection holding groove 177*i* and the second connection holding groove 177*j*. The magnetic core member 177, the longitudinal winding 178 and the lateral winding 188 constitute a coil unit 174. The coil unit 174 and the first and second capacitors 176, 186 make up the resonance circuit 173. The construction of this embodiment is the same as the sixth embodiment except as noted above.

In the tag 172 constructed as described above, the display plate 120 bonded to the surface of the magnetic core member 177 can be smoothed, and there is little or no probability that the article 11 with the tag 172 will pass between the transmitting and receiving antennas with the magnetic core member 177 having a magnetic core direction in which the sensitivity of the tag 172 deteriorates. As a result, it is possible to improve the appearance of the display plate 120, decrease the total thickness of the tag 172, and further improve the sensitivity of the tag 172, thereby securely preventing the article 11 from being stolen.

Although, in each of the sixth to ninth embodiments, the chip capacitor is used as the capacitor, and is buried in one of the sides of the magnetic core member, a flatten chip capacitor may be used. In this case, the capacitor may be bonded to one of the sides of the magnetic core member.

Although, in the ninth embodiment, the first grooves are formed to have a depth substantially the same as the diameter of the winding, and the second grooves are formed to have a depth about twice as large as the diameter of the winding, the first grooves may be formed to have a depth larger than the diameter of the winding, and the second winding may be formed to have a depth at least twice as large as the diameter of the winding. In this case, the upper surface of the winding contained in the first grooves is lower than the upper surface of the magnetic core member, but the smoothness of the display plate hardly deteriorates due to the very small width (slightly larger than the diameter of the winding) of the first grooves.

Figure 17:
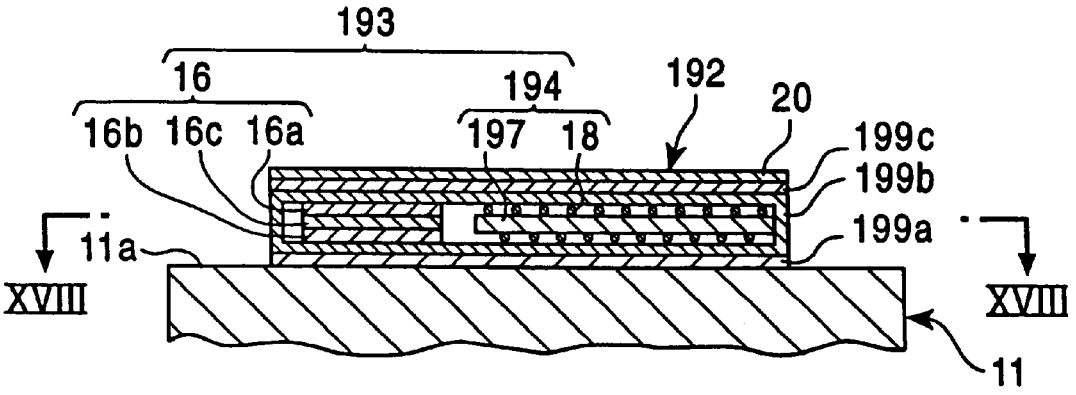
FIG. 17 is a sectional view showing a tenth embodiment of the present invention taken along line XVII—XVII in FIG. 18.
Figure 18:
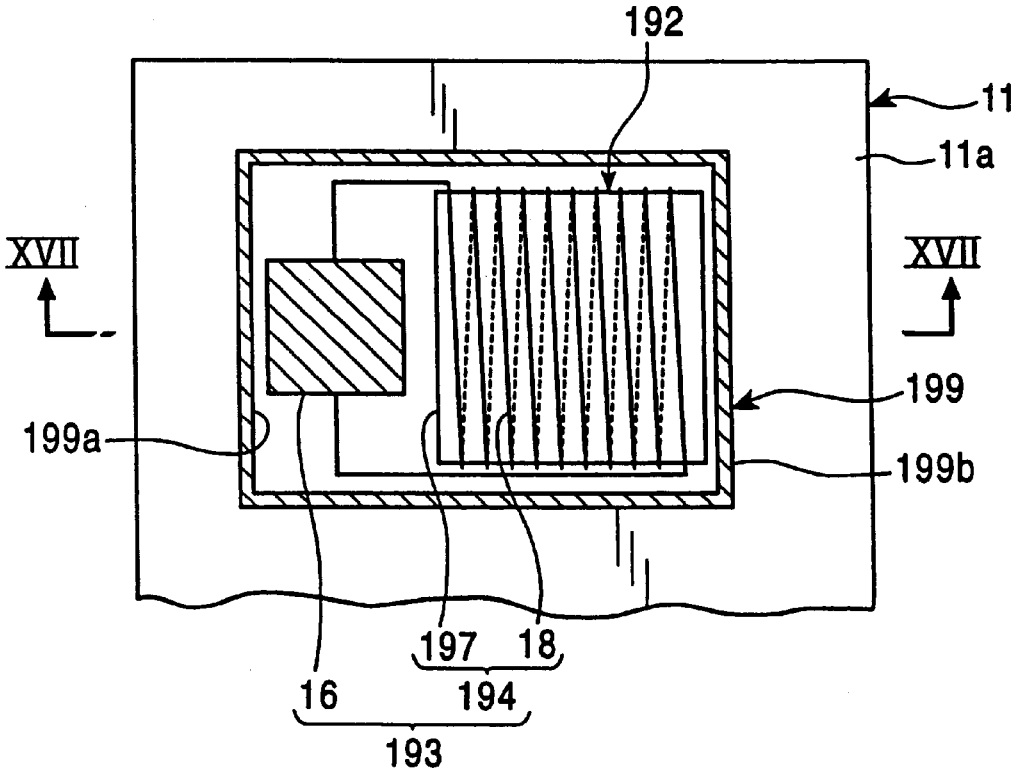
FIG. 18 is a sectional view taken along line XVIII—XVIII in FIG. 17.
Figure 19:
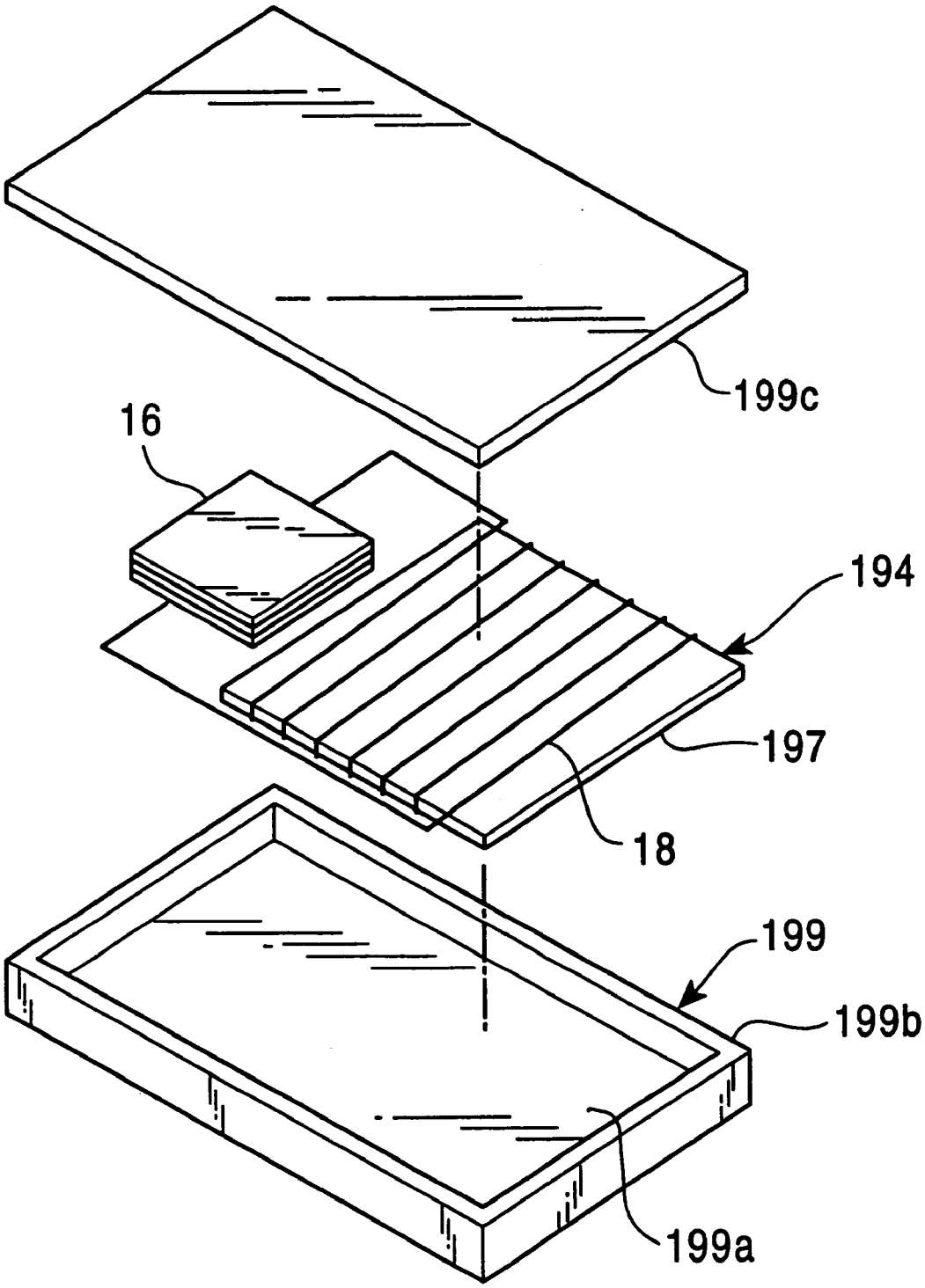
FIG. 19 is a perspective view showing a coil unit and a protecting case in a state before the coil unit is contained in the protecting case.

FIGS. 17 to 19 show a tenth embodiment of the present invention. In FIGS. 17 and 18, the same parts as FIGS. 1 and 2 are denoted by the same reference numerals.

In this embodiment, a magnetic core member 197 is made of a sintered ferrite sheet, and a winding 18 is wound around the periphery of the magnetic core member 197 to constitute a coil unit 194 which is contained in a protecting case 199. The winding 18 is wound around the periphery of the magnetic core member 197 in the same manner as the first embodiment. The protecting case 199 comprises a case body 199*b* having a holding recessed portion 199*a* which can hold the coil unit 194 and the capacitor 16, and a cover 199*c* detachable from the holding recessed portion 199*a* (FIG. 19). The case body 199*b* and the cover 199*c* is made of a resin. The coil unit 194 and the capacitor 16 constitute a resonance circuit 193. The construction of this embodiment is the same as the first embodiment except as noted above.

In the theftproof tag 192 constructed as described above, since the fragile magnetic core member 197 (sintered ferrite sheet) is protected by the protecting case 199, the operation thereof is substantially the same as the first embodiment except that the magnetic core member 197 can be protected from damage. Therefore, a repeated description is omitted.

The procedure for holding the coil unit 194 and the capacitor 16 in the protecting case 199 is described in detail below. First, a predetermined amount of adhesive is poured into the holding recessed portion 199*a* of the base body 199*b*. Then the coil unit 194 and the capacitor 16 are inserted into the holding recessed portion 199*a*. Next, an adhesive is applied to the upper sides of the coil unit 194 and the capacitor 16, and the cover 199*c* is inserted into the holding recessed portion 199*a*. Further, the protecting case 199 is maintained at a predetermined temperature for a predetermined time to dry the adhesive. As a result, the coil unit 194 and the capacitor 16 are securely fixed to the case body 199*b* by the adhesive together with the cover 199*c*, preventing the coil unit 194 and the capacitor 16 from coming loose in the protecting case 199.

The coil unit 194 or both the coil unit 194 and the capacitor 16 may be bonded to an aluminum sheet as a reinforcing member before the coil unit 194 is contained in the protecting case 199, further preventing damage of the magnetic core member 197.

EXAMPLES

The present invention is described in further detail below with reference to examples and comparative examples.

Example 1

85% by weight of nylon resin was mixed with carbonyl iron powder having an average particle diameter of 2.5 μm, followed by injection molding to form a magnetic core member 17 of 40 mm in length, 20 mm in width, and 2 mm in thickness, as shown in FIGS. 1 and 2. Around the magnetic core member 17 was wound 25 turns of covered copper wire having a diameter of 0.3 mm to obtain a coil unit 14 comprising the winding 18 wound around the periphery of the magnetic core member 17. The coil unit was considered as Example 1.

Example 2

To the coil unit of Example 1 was bonded an aluminum thin sheet (100 mm in length, 100 mm in width, and 0.3 mm in thickness) to obtain a coil unit with the aluminum thin sheet as Example 2.

Example 3

85% by weight of nylon resin was mixed with reduced iron powder having an average particle diameter of 1 μm, followed by injection molding to form a magnetic core member of 40 mm in length, 20 mm in width, and 2 mm in thickness. Around the magnetic core member was wound 25 turns of covered copper wire having a diameter of 0.3 mm to obtain a coil unit comprising a winding wound around the periphery of the magnetic core member. The coil unit was considered as Example 3.

Example 4

A water atomized powder having an average particle diameter of 10 μm and holding 78% by weight of Ni was flattened by a ball mill, and then annealed at 500° C. in an atmosphere of hydrogen gas to form flakes. The thus-formed flakes were mixed with 75% by weight of nylon resin, followed by injection molding under a magnetic filed of 2000 Oe to form a magnetic core member of 40 mm in length, 20 mm in width, and 2 mm in thickness. Around the magnetic core member was wound 25 turns of covered copper wire having a diameter of 0.3 mm to obtain a coil unit comprising a winding wound around the periphery of the magnetic core member. The coil unit was considered as Example 4.

Example 5

Droplets of a melt holding 89% by weight of Co, 5.2% by weight of Fe, 2.3% by weight of Si and 3.5% by weight of B were contacted with water-cooled copper to form amorphous flakes. 75% by weight of the flakes were mixed with 25% by weight of nylon resin, followed by injection molding under a magnetic field of 2000 Oe to form a magnetic core member of 40 mm in length, 20 mm in width, and 2 mm in thickness. Around the magnetic core member was wound 25 turns of covered copper wire having a diameter of 0.3 mm to obtain a coil unit comprising a winding wound around the periphery of the magnetic core member. The coil unit was considered as Example 5.

Example 6

To both ends of the winding of the coil unit of Example 1 was connected a capacitor having an electrostatic capacity of 64 pF to form a tag as Example 6. The resonance frequency of the tag was 8.2 NHz.

Example 7

To both ends of the winding of the coil unit with the aluminum thin sheet of Example 2 was connected a capacitor having an electrostatic capacity of 73 pF to form a tag as Example 7. The resonance frequency of the tag was 8.2 NHz.

Example 8

The magnetic core member 197 was formed by using a sintered ferrite plate of 50 mm in length, 10 mm in width, and 3 mm in thickness, as shown in FIGS. 17 to 19. Around the magnetic core member 197 was wound 16 turns of covered copper wire having a diameter of 0.3 mm to obtain a coil unit 194 comprising a winding 18 wound around the periphery of the magnetic core member 197. The coil unit 194 was bonded to an aluminum sheet (not shown) of 50 mm in length, 50 mm in width, and 0.3 mm in thickness, and then contained in a protecting case 199 of 51 mm in length, 51 mm in width, and 5.5 mm in depth (inner dimensions) made of an ABS (acrylonitrile-butadiene-styrene) resin having a thickness of 1.0 mm. The coil unit 194 contained in the protecting case 199 was considered as Example 8.

Example 9

80% by weight of nylon resin was mixed with ferrite powder having an average particle diameter of 50 μm, followed by injection molding to form a magnetic core member of 35 mm in length, 35 mm in width, and 2 mm in thickness. Around the magnetic core member was wound 20 turns of covered copper wire having a diameter of 0.3 mm to obtain a coil unit comprising the winding wound around the periphery of the magnetic core member. The coil unit was considered as Example 9.

Example 10

80% by weight of nylon resin was mixed with ferrite powder having an average particle diameter of 50 μm and carbonyl iron powder having an average particle diameter of 2 μm, followed by injection molding to form a magnetic core member of 35 mm in length, 35 mm in width, and 2 mm in thickness. Around the magnetic core member was wound 24 turns of covered copper wire having a diameter of 0.3 mm to obtain a coil unit comprising the winding wound around the periphery of the magnetic core member. The coil unit was considered as Example 10.

Example 11

As shown in FIGS. 17 to 19, to both ends of the winding 18 of the coil unit 194 of Example 8 was connected a capacitor 16 having an electrostatic capacity of 56 pF. The capacitor 16 and the coil unit 194 were contained in the protecting case 199 to form a tag 192 as Example 11. The resonance frequency of the tag 192 was 8.2 NHz.

Example 12

To both ends of the winding of the coil unit of Example 9 was connected a capacitor having an electrostatic capacity of 68 pF to form a tag as Example 12. The resonance frequency of the tag was 8.5 NHz.

Comparative Example 1

First, a base sheet of 50 mm in length, 50 mm in width, and 0.1 mm in thickness was formed by using paper as an insulating material, and a thin copper sheet having a thickness of 0.1 mm was applied to one of the sides of the base sheet. The thin copper sheet was then etched to form a coil unit having a substantially square shape and a line width of 1 mm on the base sheet. The number of the turns of the coil unit was 14. The coil unit formed on the base sheet was considered as Comparative Example 1.

Comparative Example 2

To both ends of the coil unit of Comparative Example 1 was connected a capacitor having an electrostatic capacity of 64 pF to form a tag as Comparative Example 2. The resonance frequency of the tag was 8.2 MHZ.

Comparative Test 1 and Evaluation

Each of the coil units of Examples 1, 9 and 10 was placed on an acrylic sheet (100 mm in length, 100 mm in width, and 1 mm in thickness) and an aluminum sheet (100 in length, 100 mm in width, and 1 mm in thickness). Each of the coil units of Examples 2 and 8 and Comparative Example 1 was placed on an acrylic sheet (100 mm in length, 100 mm in width, and 1 mm in thickness), an aluminum sheet (100 mm in length, 100 mm in width, and 1 mm in thickness), and a steel sheet (100 mm in length, 100 mm in width, and 1 mm in thickness).

In this state, each of the coil units was connected to RF Impedance Analyzer HP 4191A (produced by Yokokawa Hewlett-Packard Co., Ltd.) to measure the self-inductance and Q value of each of the coil units while changing the frequency. The Q value was indicated directly on the RF impedance analyzer. The results are shown in Tables 1 and 2. The acrylic sheet, the aluminum sheet and the steel sheet were used as substitutes for articles to which the tag was attached.

TABLE 1

| Measurement | Self-inductance of coil unit (μH) | | | Q value of coil unit | | |
|---|---|---|---|---|---|---|
| frequency (MHZ) | Acrylic sheet | Aluminum sheet | Steel sheet | Acrylic sheet | Aluminum sheet | Steel sheet |
| Example 1 | | | | | | |
| 5 | 5.911 | 5.300 | — | 85.6 | 79.9 | — |
| 6 | 5.915 | 5.316 | — | 94.1 | 87.2 | — |
| 7 | 5.921 | 5.337 | — | 100.8 | 90.5 | — |
| 8 | 5.929 | 5.363 | — | 104.5 | 95.3 | — |
| 9 | 5.940 | 5.393 | — | 98.3 | 95.8 | — |
| 10 | 5.950 | 5.426 | — | 94.2 | 98.6 | — |
| 11 | 5.962 | 5.464 | — | 90.3 | 86.8 | — |
| 12 | 5.976 | 5.526 | — | 89.4 | 85.8 | — |
| 13 | 5.991 | 5.553 | — | 89.9 | 83.5 | — |
| 14 | 6.006 | 5.605 | — | 89.3 | 82.1 | — |
| 15 | 6.025 | 5.663 | — | 86.9 | 79.1 | — |
| Example 2 | | | | | | |
| 5 | 5.300 | 5.095 | 5.282 | 79.9 | 77.3 | 69.3 |
| 6 | 5.316 | 5.110 | 5.292 | 87.2 | 85.6 | 76.2 |
| 7 | 5.337 | 5.125 | 5.327 | 90.5 | 90.2 | 83.5 |
| 8 | 5.363 | 5.149 | 5.327 | 95.3 | 95.5 | 83.5 |
| 9 | 5.393 | 5.186 | 5.352 | 95.8 | 95.3 | 85.1 |
| 10 | 5.426 | 5.205 | 5.370 | 98.6 | 95.9 | 87.4 |
| 11 | 5.464 | 5.019 | 5.653 | 86.8 | 95.9 | 77.9 |
| 12 | 5.526 | 5.279 | 5.373 | 85.8 | 87.7 | 78.3 |
| 13 | 5.553 | 5.301 | 5.458 | 83.5 | 86.7 | 76.4 |

TABLE 1-continued

| Measurement | Self-inductance of coil unit (μH) | | | Q value of coil unit | | |
|---|---|---|---|---|---|---|
| frequency (MHZ) | Acrylic sheet | Aluminum sheet | Steel sheet | Acrylic sheet | Aluminum sheet | Steel sheet |
| 14 | 5.605 | 5.330 | 5.491 | 82.1 | 85.6 | 76.5 |
| 15 | 5.663 | 5.363 | 5.525 | 79.1 | 83.4 | 74.6 |
| Comparative Example 1 | | | | | | |
| 5 | 5.263 | 0.812 | 1.696 | 60.0 | 7.6 | 3.4 |
| 6 | 5.310 | 0.791 | 1.616 | 66.8 | 7.6 | 3.1 |
| 7 | 5.369 | 0.774 | 1.548 | 71.3 | 7.5 | 3.0 |
| 8 | 5.444 | 0.759 | 1.491 | 75.8 | 7.3 | 2.9 |
| 9 | 5.531 | 0.739 | 1.438 | 77.0 | 7.5 | 2.9 |
| 10 | 5.632 | 0.721 | 1.389 | 80.4 | 7.4 | 2.8 |
| 11 | 5.749 | 0.705 | 1.343 | 86.0 | 5.2 | 2.7 |
| 12 | 5.885 | 0.690 | 1.298 | 84.9 | 8.2 | 2.8 |
| 13 | 6.043 | 0.688 | 1.254 | 83.8 | 7.9 | 2.8 |
| 14 | 6.220 | 0.646 | 1.211 | 82.6 | 7.8 | 2.9 |
| 15 | 6.425 | 0.623 | 1.167 | 79.2 | 8.0 | 3.0 |

TABLE 2

| Measurement | Self-inductance of coil unit (μH) | | | Q value of coil unit | | |
|---|---|---|---|---|---|---|
| frequency (MHZ) | Acrylic sheet | Aluminum sheet | Steel sheet | Acrylic sheet | Aluminum sheet | Steel sheet |
| Example 8 | | | | | | |
| 5 | 6.411 | 5.834 | 5.884 | 147.0 | 152.5 | 73.7 |
| 6 | 6.468 | 5.886 | 5.932 | 139.1 | 148.5 | 75.4 |
| 7 | 6.531 | 5.947 | 5.992 | 127.2 | 129.7 | 72.3 |
| 8 | 6.612 | 6.020 | 6.067 | 106.3 | 110.9 | 67.6 |
| 9 | 6.705 | 6.108 | 6.153 | 84.5 | 91.0 | 60.3 |
| 10 | 6.802 | 6.197 | 6.242 | 63.3 | 67.8 | 50.8 |
| 11 | 6.913 | 6.300 | 6.347 | 48.7 | 53.3 | 41.4 |
| 12 | 7.041 | 6.419 | 6.467 | 38.9 | 42.6 | 34.7 |
| 13 | 7.172 | 6.542 | 6.594 | 31.2 | 34.2 | 29.1 |
| 14 | 7.316 | 6.679 | 6.732 | 26.2 | 28.7 | 25.1 |
| 15 | 7.475 | 6.828 | 6.884 | 22.6 | 24.6 | 21.9 |
| Example 9 | | | | | | |
| 5 | 5.095 | 4.608 | — | 105.7 | 92.5 | — |
| 6 | 5.118 | 4.643 | — | 113.0 | 97.4 | — |
| 7 | 5.142 | 4.685 | — | 118.0 | 101.1 | — |
| 8 | 5.174 | 4.737 | — | 124.4 | 109.9 | — |
| 9 | 5.211 | 4.800 | — | 136.9 | 112.6 | — |
| 10 | 5.247 | 4.861 | — | 140.4 | 114.6 | — |
| 11 | 5.296 | 4.939 | — | 143.2 | 117.8 | — |
| 12 | 5.354 | 5.033 | — | 145.9 | 118.2 | — |
| 13 | 5.413 | 5.136 | — | 143.7 | 111.5 | — |
| 14 | 5.480 | 5.251 | — | 147.3 | 112.5 | — |
| 15 | 5.561 | 5.376 | — | 145.2 | 110.0 | — |
| Example 10 | | | | | | |
| 5 | 5.498 | 4.999 | — | 88.8 | 79.9 | — |
| 6 | 5.566 | 5.076 | — | 94.3 | 83.9 | — |
| 7 | 5.647 | 5.170 | — | 97.3 | 86.4 | — |
| 8 | 5.750 | 5.288 | — | 101.2 | 92.1 | — |
| 9 | 5.873 | 5.407 | — | 108.7 | 93.1 | — |
| 10 | 6.013 | 5.598 | — | 108.2 | 92.4 | — |
| 11 | 6.191 | 5.806 | — | 107.8 | 92.8 | — |
| 12 | 6.408 | 6.066 | — | 107.5 | 91.1 | — |
| 13 | 6.664 | 6.380 | — | 103.0 | 84.2 | — |
| 14 | 6.976 | 6.775 | — | 102.4 | 82.4 | — |
| 15 | 7.369 | 7.268 | — | 98.4 | 77.9 | — |

Tables 1 and 2 reveal that in Comparative Example 1, the use of the aluminum sheet as a conductive material and the steel sheet as a ferromagnetic material causes significant decreases in the self-inductance and Q value regardless of the frequency, as compared with the use of the acrylic sheet as a non-magnetic material.

On the other hand, in Examples 1, 9 and 10, the use of the aluminum sheet causes some decreases in both the self-inductance and Q value compared to the acrylic sheet, but the decreases are extremely smaller than in Comparative Example 1. Also, in Examples 1, 9 and 10, the use of the aluminum sheet showed a Q value of over 60 (the minimum value necessary for practical use) and a self-inductance of over 4 $\mu$H. Since the self-inductance of the aluminum sheet was different from the acrylic sheet, even in the same coil unit, the resonance frequency of the coil unit on the acrylic sheet was slightly different from the coil unit on the aluminum sheet. However, such a degree of difference in resonance frequency falls in a practicable range.

In Example 2, in all cases of the acrylic sheet, the aluminum sheet and the steel sheet, the Q value was 60 or more, and the self-inductance slightly changed with the materials of the acrylic sheet, the aluminum sheet and the steel sheet. In Example 8, in the cases of the acrylic sheet and aluminum sheet, the Q value was 60 or more at a measurement frequency of 10 MHZ or less, and in the case of the steel sheet, the Q value was 60 or more at a measurement frequency of 9 MHZ or less. In the cases of the acrylic sheet, the aluminum sheet and the steel sheet, the self-inductance slightly changed with the material.

Comparative Test 2 and Evaluation

Each of the coil units of Examples 1, 3 to 5 and 8 to 10 was placed on an acrylic sheet (100 mm in length, 100 mm in width, and 1 mm in thickness), and an electric wave was applied to each of the coils with varying frequencies in the same manner as Example 1 to measure the L and Q values. The results are shown in Tables 3 and 4.

TABLE 3

| Measurement frequency (MHZ) | Self-inductance of coil unit ($\mu$H) | | | | Q value of coil unit | | | |
|---|---|---|---|---|---|---|---|---|
| | Example 1 | Example 3 | Example 4 | Example 5 | Example 1 | Example 3 | Example 4 | Example 5 |
| 5 | 5.911 | 5.468 | 6.562 | 5.882 | 85.6 | 77.0 | 72.7 | 73.4 |
| 6 | 5.915 | 5.501 | 6.684 | 5.868 | 94.1 | 86.6 | 79.0 | 79.8 |
| 7 | 5.921 | 5.536 | 6.809 | 5.856 | 100.8 | 94.8 | 83.7 | 84.4 |
| 8 | 5.929 | 5.573 | 6.937 | 5.846 | 104.5 | 96.3 | 85.7 | 86.5 |
| 9 | 5.940 | 5.613 | 7.068 | 5.839 | 98.3 | 97.3 | 79.6 | 80.4 |
| 10 | 5.950 | 5.653 | 7.200 | 5.831 | 94.2 | 99.5 | 71.4 | 72.1 |
| 11 | 5.962 | 5.693 | 7.333 | 5.825 | 90.3 | 100.1 | 71.3 | 72.0 |
| 12 | 5.976 | 5.737 | 7.470 | 5.820 | 89.4 | 99.0 | 69.7 | 70.4 |
| 13 | 5.991 | 5.781 | 7.608 | 5.817 | 89.9 | 95.3 | 69.2 | 69.8 |
| 14 | 6.006 | 5.826 | 7.748 | 5.814 | 89.3 | 94.4 | 67.9 | 68.5 |
| 15 | 6.025 | 5.874 | 7.893 | 5.814 | 86.9 | 93.6 | 65.2 | 65.7 |

TABLE 4

| Measurement frequency (MHZ) | Self-inductance of coil unit ($\mu$H) | | | Q value of coil unit | | |
|---|---|---|---|---|---|---|
| | Example 8 | Example 9 | Example 10 | Example 8 | Example 9 | Example 10 |
| 5 | 6.411 | 5.095 | 5.498 | 147.G | 105.7 | 88.8 |
| 6 | 6.468 | 5.118 | 5.566 | 139.1 | 113.0 | 94.3 |
| 7 | 6.531 | 5.142 | 5.647 | 127.2 | 118.0 | 97.3 |
| 8 | 6.612 | 5.174 | 5.750 | 106.3 | 124.4 | 101.2 |
| 9 | 6.705 | 5.211 | 5.873 | 84.5 | 138.9 | 108.7 |
| 10 | 6.802 | 5.247 | 6.013 | 63.3 | 140.4 | 108.2 |
| 11 | 6.913 | 5.296 | 6.191 | 48.7 | 143.2 | 107.8 |
| 12 | 7.041 | 5.354 | 6.408 | 38.9 | 145.9 | 107.5 |
| 13 | 7.172 | 5.413 | 6.664 | 31.2 | 143.7 | 103.0 |
| 14 | 7.316 | 5.480 | 6.976 | 26.2 | 147.3 | 102.4 |
| 15 | 7.475 | 5.561 | 7.369 | 22.6 | 145.2 | 98.4 |

Tables 3 and 4 reveal that in the coil units of Examples 1, 3 to 5 and 8 to 10, the self-inductance and the Q value are as high as 4 $\mu$H or more and 60 or more, respectively.

Comparative Test 3 and Evaluation

Each of the tags of Examples 6, 7, 11 and 12 and Comparative Example 2 was placed on an acrylic sheet, an aluminum sheet, and a steel sheet, and an operation test was carried out by using a theftproof monitor for each of the tags. The theftproof monitor is comprised of a transmitting antenna and a receiving antenna which are provided in a standing condition at a predetermined distance therebetween, and a control unit in which control input is connected to the receiving antenna, and control output is connected to the transmitting antenna and a speaker. The operation test was carried out by examining whether or not the speaker generated an alarm while changing the direction of the tag and the position between the transmitting antenna and the receiving antenna where the tag was passed. The results obtained are shown in Table 5. In Table 5, "o" marks indicate that the speaker generated an alarm regardless of the direction of the tag and the position between the transmitting and receiving antennas where the tag was passed, "Δ" marks indicate that the speaker generated an alarm only when the tag was passed in the specified direction through the specified position between the transmitting and receiving antennas, and "X" marks indicate that the speaker generated no alarm regardless of the direction of the tag and the position between the transmitting and receiving antennas where the tag was passed.

TABLE 5

| | Rate of generation of alarm from speaker | | |
|---|---|---|---|
| | Acrylic sheet | Aluminum sheet | Steel sheet |
| Example 6 | ○ | Δ | Δ |
| Example 7 | ○ | ○ | ○ |
| Example 11 | ○ | Δ | Δ |
| Example 12 | ○ | ○ | ○ |
| Comparative Example 2 | ○ | X | X |

Table 5 reveals that in the tag of Comparative Example 2 placed on any one of the sheets, the speaker generated no alarm regardless of the direction of the tag and the position between the transmitting and receiving antennas where the tag was passed. On the other hand, in the tags of Examples 6 and 11 placed on the aluminum or steel sheet, the speaker generated an alarm only when the tag was passed in the specified direction through the specified position between the transmitting and receiving antennas, while in the tags placed on the acrylic sheet, the speaker generated an alarm regardless of the direction of the tag and the position between the transmitting and receiving antennas where the tag was passed. In the tags of Examples 7 and 12 placed on any one of the sheets, the speaker generated an alarm regardless of the direction and the position between the transmitting and receiving antennas where the tag was passed. This is possibly due to the fact that in Example 7, the aluminum thin sheet attached to the coil unit electromagnetically cuts off the coil unit from the aluminum sheet or steel sheet, thereby completely preventing a change in the self-inductance and a decrease in the Q value of the coil unit.

As described above, in the present invention, the magnetic core member of the coil unit is made of a composite material composed of soft magnetic metal powder or flakes, and a plastic, and the winding wound around the periphery of the magnetic core member is connected to the capacitor, and a portion of the periphery of the magnetic core member faces the attaching surface of an article. Therefore, when the resonance circuit is attached to an article made of a conductive material such as an aluminum sheet, or a ferromagnetic material such as a steel sheet or the like, the electric wave emitted from the resonance circuit which resonates is transmitted in the magnetic core direction of the magnetic core member, i.e., in parallel with the attaching surface of the article, does not pass through the article, and is thus hardly influenced by the material of the article. As a result, the self-inductance of the coil unit does not decrease regardless of the material of the article, and thus the resonance frequency of the resonance circuit hardly changes. Also, the Q value of the coil unit does not decrease, and thus the resonance width of the resonance frequency is decreased, thereby improving the resonance characteristics of the tag, and decreasing the number of errors in the operation of the theftproof monitor.

Even if the magnetic core member is made of a sintered ferrite sheet, a composite material composed of a ferrite powder and a plastic, or a compound material composed of a soft magnetic metal powder or flakes, a ferrite powder and a plastic, the same effects as described above can be obtained.

In the use of carbonyl iron powder, reduced iron powder, flakes or flake-shaped amorphous alloy formed by flattening a soft magnetic metal powder pulverized by atomization as the soft magnetic metal, the soft magnetic metal can be formed in an optimum shape using an optimum material, and thus the resonance characteristics of the tag can be improved.

With a non-magnetic sheet or foil having conductivity and bonded to the coil unit facing the attaching surface of the article made of a ferromagnetic material, the portion of the magnetic flux emitted from the magnetic core member and passing through the portion of the article, to which the tag is attached, passes above the sheet or foil having high conductivity, and the sheet or foil causes less hysteresis loss, thereby causing substantially no eddy current. As a result, the resonance circuit is not influenced by the article made of a ferromagnetic material, and the coil unit is electromagnetically cut off from the article, thereby completely preventing a change in the self-inductance and a decrease in the Q value of the coil unit.

Also, where the capacitor is bonded to the coil unit facing the attaching surface of the article so that one of the electrodes of the capacitor also serves as a non-magnetic sheet or foil having conductivity, the resonance circuit is not influenced by the article made of a ferromagnetic material, and the coil unit is electromagnetically cut off from the article, as described above. Therefore, it is possible to completely prevent a change in the self-inductance and a decrease in the Q value of the coil unit, and decrease the number of the parts required and the total surface area of the tag.

In the use of a single or a plurality of magnetic core members having different magnetic core directions, there is little or no probability that the tag will pass between the transmitting and receiving antennas with the magnetic core member having the magnetic core direction in which the sensitivity deteriorates. As a result, the sensitivity of the tag is further improved, and stealing of the article can be securely prevented.

Where the portion of the magnetic core member on which the winding is provided has a smooth recessed portion which can contain the entire winding, or a plurality of grooves which can respectively contain the turns of the winding, the winding does not project from the recessed portion or the grooves, and thus the display plate bonded to the surface of the magnetic core member can be smoothed, thereby improving the appearance of the display plate and decreasing the total thickness of the tag.

Where the grooves comprise a plurality of first grooves and a plurality of second grooves, and the second grooves are formed in a direction different from the first grooves to have a depth twice or more as large as the diameter of the winding, the display plate bonded to the surface of the magnetic core member can be smoothed, and there is little or no probability that the tag will pass between the transmitting and receiving antennas with the magnetic core member having the magnetic core direction in which the sensitivity deteriorates. As a result, it is possible to improve the appearance of the display plate, decrease the total thickness of the tag, further improve the sensitivity of the tag, and thus securely prevent the theft of the article.

In the use of a chip capacitor as the capacitor, which is buried in or bonded to the side of the magnetic core member, the smoothness of the display plate bonded to the surface of the magnetic core member doe not deteriorate, thereby improving the appearance of the display plate and decreasing the total thickness of the tag.

Furthermore, with the magnetic core member comprising the coil unit made of a sintered ferrite sheet and contained in a protecting case, the fragile magnetic core member (sintered ferrite sheet) is protected by the protecting case, and thus damage to the magnetic core member can be prevented.

What is claimed is:

1. A tag for attachment to an article to prevent theft of the article, comprising:

a resonance circuit which resonates upon receiving an input at a specified frequency, wherein said resonance circuit includes a coil unit and a capacitor, said capacitor being electrically connected to both ends of said coil unit;

said coil unit includes a magnetic core member and a winding wound around a periphery of said magnetic core member, said winding being connected to said capacitor, wherein a portion of said periphery of said magnetic core member faces an attaching surface of the article, and wherein said magnetic core is made of a composite material composed of any one of a powder and flakes of a soft magnetic material, and a plastic.

2. The tag according to claim 1, wherein said magnetic core member is made of a composite material composed of a ferrite powder and a plastic.

3. The tag according to claim 1, wherein said magnetic core member further includes a powder of flakes of a soft magnetic metal.

4. The tag according to claim 1, wherein said soft magnetic material is a carbonyl iron powder.

5. The tag according to claim 1, wherein said soft magnetic material is a reduced iron powder.

6. The tag according to claim 1, wherein said soft magnetic material is formed in flakes by pulverizing by atomization to form a powder and then flattening said powder.

7. The tag according to claim 1, wherein said soft magnetic material is a flake-shaped amorphous alloy.

8. The tag according to claim 1, further comprising any one of a non-magnetic electromagnetic shielding sheet and a foil having conductivity which is bonded to said coil unit which faces the attaching surface of the article.

9. The tag according to claim 1, wherein said capacitor is bonded to said coil unit which faces the attaching surface of the article, said capacitor having one electrode which serves as any one of a non-magnetic electromagnetic shielding sheet and a foil having conductivity.

10. The tag according to claim 1, wherein said magnetic core member has different magnetic core directions.

11. The tag according to claim 1, wherein said magnetic core member has a smooth recessed portion formed to a depth substantially equal to a diameter of said winding, around which said winding is wound so that said winding is contained in said smooth recessed portion.

12. The tag according to claim 1, wherein said magnetic core member contains a plurality of grooves, around which said winding is wound so that turns of said winding are contained in said plurality of grooves.

13. The tag according to claim 12, wherein said plurality of grooves include a plurality of first grooves formed to a depth at least equal to a diameter of said winding, and a plurality of second grooves formed in a direction different from said plurality of first grooves and having a depth at least twice as deep as said diameter of said winding.

14. The tag according to claim 1, wherein said capacitor is a chip capacitor and is any one of bonded to and buried in a side of said magnetic core member.

15. The tag according to claim 1, wherein said capacitor is a chip capacitor and is provided in parallel with said magnetic core member.

16. The tag according to claim 1, wherein said coil unit is contained in a protecting case.

17. A tag for attachment to an article to prevent theft of the article, comprising:

a resonance circuit which resonates upon receiving an input at a specified frequency, wherein said resonance circuit includes a coil unit and a capacitor said capacitor being electrically connected to both ends of said coil unit;

said coil unit includes a magnetic core member and a winding wound around a periphery of said magnetic core member, said winding being connected to said capacitor, wherein a portion of said periphery of said magnetic core member faces an attaching surface of the article, wherein said magnetic core member is made of a sintered ferrite sheet; and a display plate structurally configured to display a price.

18. A tag for attachment to an article to prevent theft of the article, comprising:

a resonance circuit which resonates upon receiving an input at a specified frequency, wherein said resonance circuit includes a coil unit and a capacitor, said capacitor being electrically connected to both ends of said coil unit;

said coil unit includes a magnetic core member and a winding wound around an outer periphery of said magnetic core member, said winding being connected to said capacitor, wherein a portion of said periphery of said magnetic core member faces an attaching surface of the article; and a plurality of grooves formed in said outer periphery of said magnetic core member, wherein said winding is wound around said magnetic core member so that turns of said winding are contained in said plurality of grooves.

* * * * *